US011479891B2

(12) United States Patent
Osamura et al.

(10) Patent No.: US 11,479,891 B2
(45) Date of Patent: Oct. 25, 2022

(54) HOLDING FRAME AND HOLDER

(71) Applicant: BROTHER KOGYO KABUSHIKI KAISHA, Nagoya (JP)

(72) Inventors: Takahira Osamura, Kitanagoya (JP); Mitsuhiro Iida, Gifu (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 35 days.

(21) Appl. No.: 17/021,524

(22) Filed: Sep. 15, 2020

(65) Prior Publication Data

US 2021/0087730 A1 Mar. 25, 2021

(30) Foreign Application Priority Data

Sep. 20, 2019 (JP) ..... JP2019-171256

(51) Int. Cl.
*D05B 39/00* (2006.01)
*H01F 7/02* (2006.01)

(52) U.S. Cl.
CPC ..... *D05B 39/00* (2013.01); *D05D 2207/06* (2013.01); *H01F 7/02* (2013.01)

(58) Field of Classification Search
CPC ..... D05B 39/00; D05B 91/10; D05C 9/04; D05C 1/02
See application file for complete search history.

(56) References Cited

U.S. PATENT DOCUMENTS 5,586,400 A * 12/1996 Moore, III ..... D05C 9/04 112/103
2003/0074815 A1* 4/2003 Tajima ..... D05C 9/04 38/102.2
2005/0229366 A1* 10/2005 Hori ..... D05C 9/04 24/455
2006/0180064 A1* 8/2006 Okazaki ..... D05C 9/04 112/103
2008/0098940 A1* 5/2008 Kuki ..... D05B 39/00 112/103

(Continued)

FOREIGN PATENT DOCUMENTS

JP 2010-082017 A 4/2010
JP 2010082017 A * 4/2010 ..... D05B 39/00

(Continued)

*Primary Examiner* — Nathan E Durham
(74) *Attorney, Agent, or Firm* — Oliff PLC

(57) ABSTRACT

In a holding frame, a frame forming portion includes a first holding surface and the second holding surface extending in different directions crossing an area surface of an inner area defined by the frame forming portion. In a state where a holder is magnetically attached to the frame forming portion, the first holding surface and the second holding surface respectively face inner surfaces of a first holding portion and a second holding portion of the holder. The first holding surface includes a first portion connected to a first connecting portion, and a first end located opposite from the first portion. The second holding surface includes a second portion connected to the first connecting portion, and a second end located opposite from the second portion. A distance between the first end and the second end is greater than a distance between the first portion and the second portion.

13 Claims, 27 Drawing Sheets

(56) References Cited

U.S. PATENT DOCUMENTS

| | | | | |
|---|---|---|---|---|
| 2008/0202399 | A1* | 8/2008 | Mack | D05B 39/00 112/103 |
| 2015/0059632 | A1* | 3/2015 | Amakawa | D05C 9/04 112/103 |
| 2015/0240402 | A1* | 8/2015 | Magara | D05B 39/00 112/103 |
| 2019/0338450 | A1 | 11/2019 | Kawaguchi et al. | |

FOREIGN PATENT DOCUMENTS

| | | | |
|---|---|---|---|
| JP | 5478046 | B2 | 4/2014 |
| JP | 2018-123445 | A | 8/2018 |

* cited by examiner

HOLDING FRAME AND HOLDER

CROSS-REFERENCE TO RELATED APPLICATION

This application claims priority from Japanese Patent Application No. 2019-171256 filed on Sep. 20, 2019, the content of which is incorporated herein by reference in its entirety.

TECHNICAL FIELD

Aspects of the disclosure relate to a holding frame and a holder.

BACKGROUND

A known holding frame incudes four frame sides and a holder. The holder includes a top portion and two guide pieces extending from opposite ends of the top portion. Each frame side has a rectangular or square shape in cross-section. The holder is U-shaped and the two guide pieces are parallel to each other. Accordingly, the two guide pieces are attached to opposite surfaces of the frame side in parallel with the opposite surfaces. One of the top portion of the holder and a frame side facing the top portion includes a magnet, and the other includes an attracted member. The holder is attached over the frame side, via a fabric, to hold the fabric taut.

SUMMARY

However, as in the known holding frame, in a case where a distance between lower ends of inner surfaces of the two guide pieces is less than or equal to a distance between upper portions of the inner surfaces of the two guide pieces, the holder may be unable to hold a workpiece against the frame side when the thickness varies considerably from one workpiece to another.

Aspects of the disclosure provide a holding frame including a holder and a frame forming portion which are configured to hold a workpiece therebetween even when the thickness varies considerably from one workpiece to another, and other aspects of the disclosure provide the holder.

According to one or more aspects of the disclosure, a holding frame includes a frame forming portion defining an inner area which extends in a direction in which a workpiece is stretched taut, and a holder configured to be magnetically attached to the frame forming portion. The frame forming portion includes a first holding surface, a second holding surface, and a first connecting portion connecting the first holding surface and the second holding surface. The holder includes a first holding portion, and a second holding portion. The first holding surface and the second holding surface extend in two different directions crossing an area surface of the inner area. The first holding surface includes a first portion connected to the first connecting portion, and a first end located opposite from the first portion. The second holding surface includes a second portion connected to the first connecting portion, and a second end located opposite from the second portion. A distance between the first end and the second end is greater than a distance between the first portion and the second portion. In a state where the holder is attached to the frame forming portion, the first holding surface faces an inner surface of the first holding portion, and the second holding surface faces an inner surface of the second holding portion. One of the holder and the frame forming portion includes a magnet and the other includes a magnetic material.

According to one or more aspects of the disclosure, a holding frame includes a frame forming portion and a holder. The frame forming portion includes four frame sides defining an inner area which extends in a direction in which a workpiece is stretched taut. Each of the four frame sides includes a first holding surface, a second holding surface, a first connecting portion connecting the first holding surface and the second holding surface, and a portion including a magnetic material. The holder includes a first holding portion, and a second holding portion. The first holding surface and the second holding surface extend in two different directions crossing an area surface of the inner area. The first holding surface is a plane perpendicular to the area surface and located outside the second holding surface in an outward direction away from the inner area of the frame forming portion. The first holding surface includes a first portion connected to the first connecting portion, and a first end located opposite from the first portion. The second holding surface includes a second portion connected to the first connecting portion, and a second end located opposite from the second portion. A distance between the first end and the second end is greater than a distance between the first portion and the second portion. In a state where the holder is attached to a corresponding one of the frame sides, the first holding surface of the corresponding frame side faces an inner surface of the first holding portion, and the second holding surface of the corresponding frame side faces an inner surface of the second holding portion. The first holding portion includes, on the inner surface thereof, a first permanent magnet, and the second holding portion includes, on the inner surface thereof, a second permanent magnet.

According to one or more aspects of the disclosure, a holding frame includes a frame forming portion defining an inner area which extends in a direction in which a workpiece is stretched taut, and a holder configured to be magnetically attached to the frame forming portion. The frame forming portion includes a first holding surface, and a second holding surface. The holder includes a first holding portion, a second holding portion, and a second connecting portion connecting the first holding portion and the second holding portion. In a state where the holder is attached to the frame forming portion, the first holding portion and the second holding portion extend in two different directions crossing an area surface of the inner area. The first holding portion includes a third portion connected to the second connecting portion, and a third end located opposite from the third portion. The second holding portion includes a fourth portion connected to the second connecting portion, and a fourth end located opposite from the fourth portion. A distance between an inner surface at the third end of the first holding portion and an inner surface at the fourth end of the second holding portion is greater than a distance between the inner surface at the third portion of the first holding portion and the inner surface at the fourth portion of the second holding portion. In the state where the holder is attached to the frame forming portion, the first holding surface faces the inner surface of the first holding portion, and the second holding surface faces the inner surface of the second holding portion. One of the holder and the frame forming portion includes a magnet and the other includes a magnetic material.

According to one or more aspects of the disclosure, a holding frame includes a frame forming portion defining an inner area which extends in a direction in which a workpiece is stretched taut, and a holder configured to be magnetically attached to the frame forming portion. The frame forming portion includes a first holding surface, and a second holding surface. The holder includes a first holding portion, a second holding portion, and a second connecting portion connecting the first holding portion and the second holding portion. In a state where the holder is attached to the frame forming portion, the first holding portion extends in a direction parallel to an area surface of the inner area, and the second holding portion extends in a direction crossing the area surface. The first holding portion includes a third portion connected to the second connecting portion, and a third end located opposite from the third portion. The second holding portion includes a fourth portion connected to the second connecting portion, and a fourth end located opposite from the fourth portion. A distance between an inner surface at the third end of the first holding portion and an inner surface at the fourth end of the second holding portion is greater than a distance between the inner surface at the third portion of the first holding portion and the inner surface at the fourth portion of the second holding portion. In the state where the holder is attached to the frame forming portion, the third end is configured such that the holder is movable in the direction parallel to the area surface. In the state where the holder is attached to the frame forming portion, the first holding surface faces the inner surface of the first holding portion, and the second holding surface faces the inner surface of the second holding portion. One of the holder and the frame forming portion includes a magnet and the other includes a magnetic material.

According to one or more aspects or the disclosure, a holder is configured to be magnetically attached to a holding frame which includes a frame forming portion defining an inner area extending in a direction in which a workpiece is stretched taut. The holder includes a first holding portion, a second holding portion, and a second connecting portion connecting the first holding portion and the second holding portion. In a state where a holder is attached to the frame forming portion, the first holding portion and the second holding portion extend in two different directions crossing an area surface of the inner area. The first holding portion includes a third portion connected to the second connecting portion, and a third end located opposite from the third portion. The second holding portion includes a fourth portion connected to the second connecting portion, and a fourth end located opposite from the fourth portion. A distance between an inner surface at the third end of the first holding portion and an inner surface at the fourth end of the second holding portion is greater than a distance between the inner surface at the third portion of the first holding portion and the inner surface at the fourth portion of the second holding portion. At least one of the first holding portion, the second holding portion, and the second correcting portion includes a magnet.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

First to third illustrative embodiments of the disclosure will now be described with reference to the drawings. In each of the first to third illustrative embodiments, a holding frame according to aspects of the disclosure is applied to a holding frame to be mounted on a sewing machine.

First Illustrative Embodiment

Figure 1:
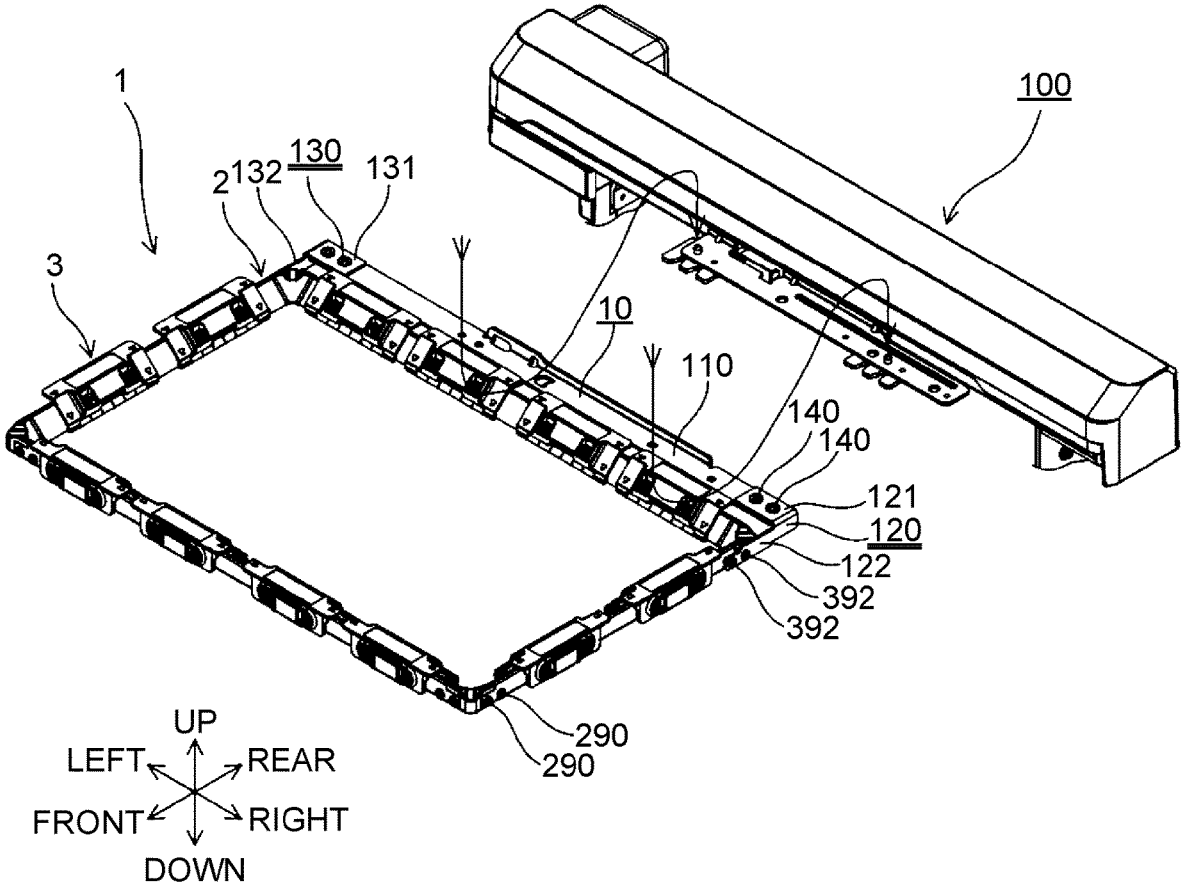
FIG. 1 is a perspective view of a holding frame and a mount of a sewing machine, according to a first illustrative embodiment.

Referring to FIGS. 1 to 14, the structure of a holding frame 1 according to a first illustrative embodiment will be described. Referring to FIG. 1, the overall external structure of a holding frame 1 according to the first illustrative embodiment will be described. The holding frame 1 is detachably mounted on a sewing machine, via a mount 100 of the sewing machine. Since the structure of a sewing machine is described in detail in Japanese Laid-Open Patent Application No. 2018-123445, a description of a sewing machine will be omitted herein. The holding frame 1 includes a frame body 2 and holders 3 which are attachable to and detachable from the frame body 2. In the following description, an up-down direction, a front-rear direction, and a left-right direction are defined, as shown by arrows in FIG. 1, when viewed facing the front of a sewing machine.

Structure of Frame Body 2

Figure 2:
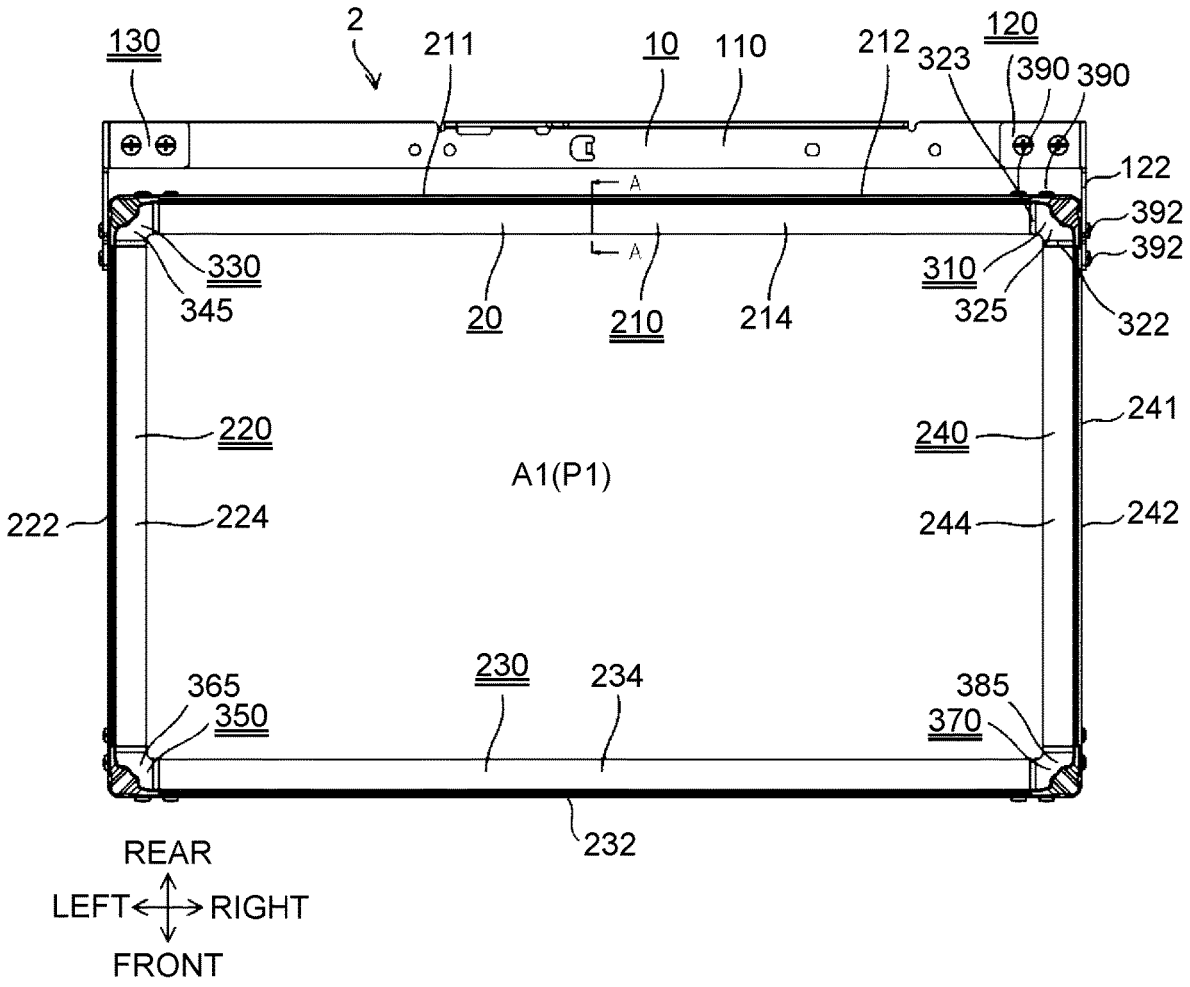
FIG. 2 is a top plan view of a frame body of the holding frame.

Referring to FIGS. 1 and 2, the structure of the frame body 2 will be described in detail. The frame body 2 includes an attachment 10 and a frame forming portion 20. The attachment 10 is connected to the frame forming portion 20.

Structure of Attachment 10

The attachment 10 is made of a magnetic material and may be a steel plate. The attachment 10 includes an attachment body 110 and two fixtures 120 and 130. As shown in FIG. 2, the attachment body 110 is a flat portion extending in the left-right direction. The attachment body 110 has four holes and four screw holes. The four holes and the four screw holes are formed through the attachment body 110 in the up-down direction. The four holes are used to mount the holding frame 1 on the mount 100 of the sewing machine. Two of the four screw holes are located adjacent to a right end of the attachment body 110. The other two of the four screw holes are located adjacent to a left end of the attachment body 110. The fixtures 120 and 130 are substantially L-shaped. As shown in FIG. 1, the fixture 120 includes side plates 121 and 122. The side plate 121 is a flat portion extending in the front-rear direction and in the left-right direction. Two holes are formed through the side plate 121 in the up-down direction. The side plate 122 is a flat portion extending in the up-down direction and in the front-rear direction. The two holes are formed through the side plate 122 in the left-right direction. A right portion of the side plate 121 is connected to an upper portion of the side plate 122. The fixture 130 includes side plates 131 and 132 which respectively correspond to the side plates 121 and 122 of the fixture 120. Since the fixture 130 has the same structure as the fixture 120 except that a left portion of the side plate 131 is connected to an upper portion of the side plate 132, a description of the fixture 130 will be omitted.

Assembly of Attachment 10

The side plate 121 of the fixture 120 is placed on the attachment body 110 such that the two holes of the side plate 121 respectively communicate with the two screw holes located on the right side of the attachment body 110 and that the side plate 122 protrudes frontward. The fixture 120 is fixed to the right side of the attachment body 110 with two screws 140 respectively inserted into the holes of the side plate 121 and threadedly engaged with the screw holes of the attachment body 110. The fixture 130 is fixed to a left side of the attachment body 110 in a similar manner for fixing the fixture 120 to the attachment body 110.

Structure of Frame Forming Portion 20

As shown in FIG. 2, the frame forming portion 20 is substantially rectangular in plan view. The frame forming portion 20 includes four frame sides 210, 220, 230, and 240 and four corners 310, 330, 350 and 370.

Structures of Frame Sides 210, 220, 230, and 240

The frame sides 210, 220, 230, and 240 each are made of a magnetic material, such as a steel plate. The frame sides 210, 220, 230 and 240 have a linear shape extending in their longitudinal directions. The frame sides 210 and 230 have the same length in their longitudinal directions which correspond to the left-right direction in FIG. 2. The frame sides 220 and 240 have the same length in their longitudinal directions which correspond to the front-rear direction in FIG. 2. The frame sides 210 and 230 have a greater length in their longitudinal directions than the frame sides 220 and 240. The frame sides 210, 220, 230 and 240 have the same structure except that the frame sides 210, 220, 230, and 240 are not uniform in longitudinal length. The structure of the frame side 210, out of the frame sides 210, 220, 230, and 240, will be representatively described referring to FIGS. 2 and 3. Herein, a longitudinal direction, a width direction, and a height direction of the frame side 210 are defined, based on a longer length of the frame side 210, as shown by arrows in FIG. 3. For clarity of illustration, hatching is omitted from FIG. 3.

Figure 3:
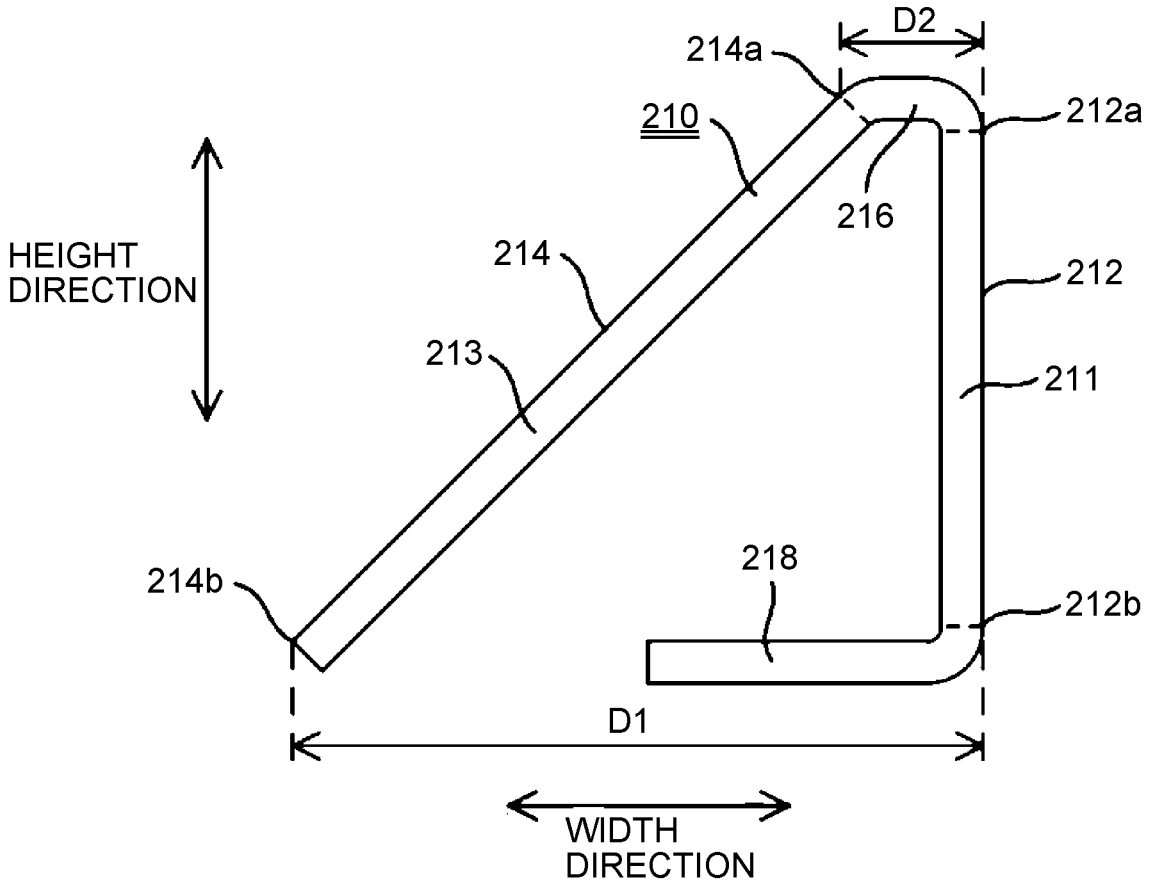
FIG. 3 is a cross-sectional view of a frame side of the frame body taken along line A-A of FIG. 2.

As shown in FIG. 3, the frame side 210 has a substantially right triangle cross-section. The frame side 210 is so formed by bending a flat plate made of a magnetic material. The frame side 210 includes side plates 211 and 213, a first connecting portion 216, and a bottom plate 218. The side plate 211 is a flat portion extending in the height direction and in the longitudinal direction. An outer surface of the side plate 211 is a first holding surface 212. The first holding surface 212 includes a first portion 212*a* and a first end 212*b*. The first portion 212*a* is located on one side of the first holding surface 212 in the height direction. The first end 212*b* is an end located on the other side of the first holding surface 212 in the height direction. Namely, the first end 212*b* and the first portion 212*a* are located on opposite sides of the first holding surface 212 in the height direction. An end means the farthest part of an element beyond which it does not exist, and the farthest part may or may not be connected to another element. The side plate 211 has, on its one side in the longitudinal direction, two holes formed therethrough in the width direction. The side plate 211 has, on its other side in the longitudinal direction, two holes formed therethrough in the width direction. The side plate 213 is a flat portion inclined by 45 degrees relative to the width direction and extending in the longitudinal direction. Namely, in the first illustrative embodiment, an angle formed by the side plate 211 and the side plate 213 is set to 45 degrees. When the holding frame 1 holds a fabric 4, the side plate 211 and the side plate 213 which form an acute angle therebetween allow the holder 3 to shift upward relative to the frame body 2. This provides a sufficient gap between the holder 3 and the frame body 2, depending on the thickness of the fabric 4, and enables the holding frame 1 to hold the fabric 4. The holding frame 1 holds the fabric 4 in a bent manner. This reduces sliding of the fabric 4 between the holder 3 and the holder body 2 when the fabric 4 held therebetween is pulled. An outer surface of the side plate 213 is a second holding surface 214. The second holding surface 214 includes a second portion 214*a* and a second end 214*b*. The second portion 214*a* is located on one side of the second holding surface 214 in the height direction. The second end 214*b* is located on the other side of the second holding surface 214 in the height direction. Namely, the second end 214*b* and the second portion 214*a* are located on opposite sides of the second holding surface 214 in the height direction. The first connecting portion 216 is arcuate. A portion on one side of the first connecting portion 216 in the width direction is connected to the first portion 212*a* of the first holding surface 212. A portion on the other side of the first connecting portion 216 in the width direction is connected to the second portion 214*a* of the second holding surface 214. The bottom plate 218 is a flat portion parallel to the width direction and extending in the longitudinal direction. A portion on one side of the bottom plate 218 in the width direction is connected to the first end 212*b* of the first holding surface 212. As shown in FIG. 3, the frame side 210 has a substantially right triangle cross-section, and thus a distance D1 between the first end 212*b* and the second end 214*b* is greater than a distance D2 between the first portion 212*a* and the second portion 214*a*.

Structures of Corners 310, 330, 350, and 370

Figure 4:
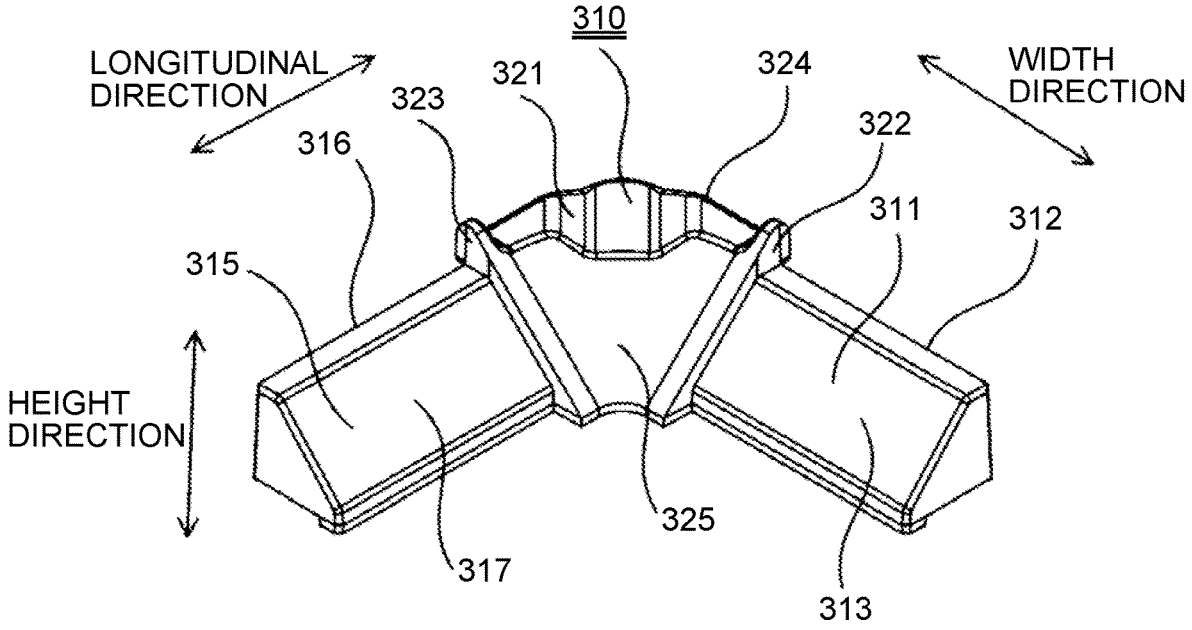
FIG. 4 is a perspective view of a corner of the frame body.
Figure 5:
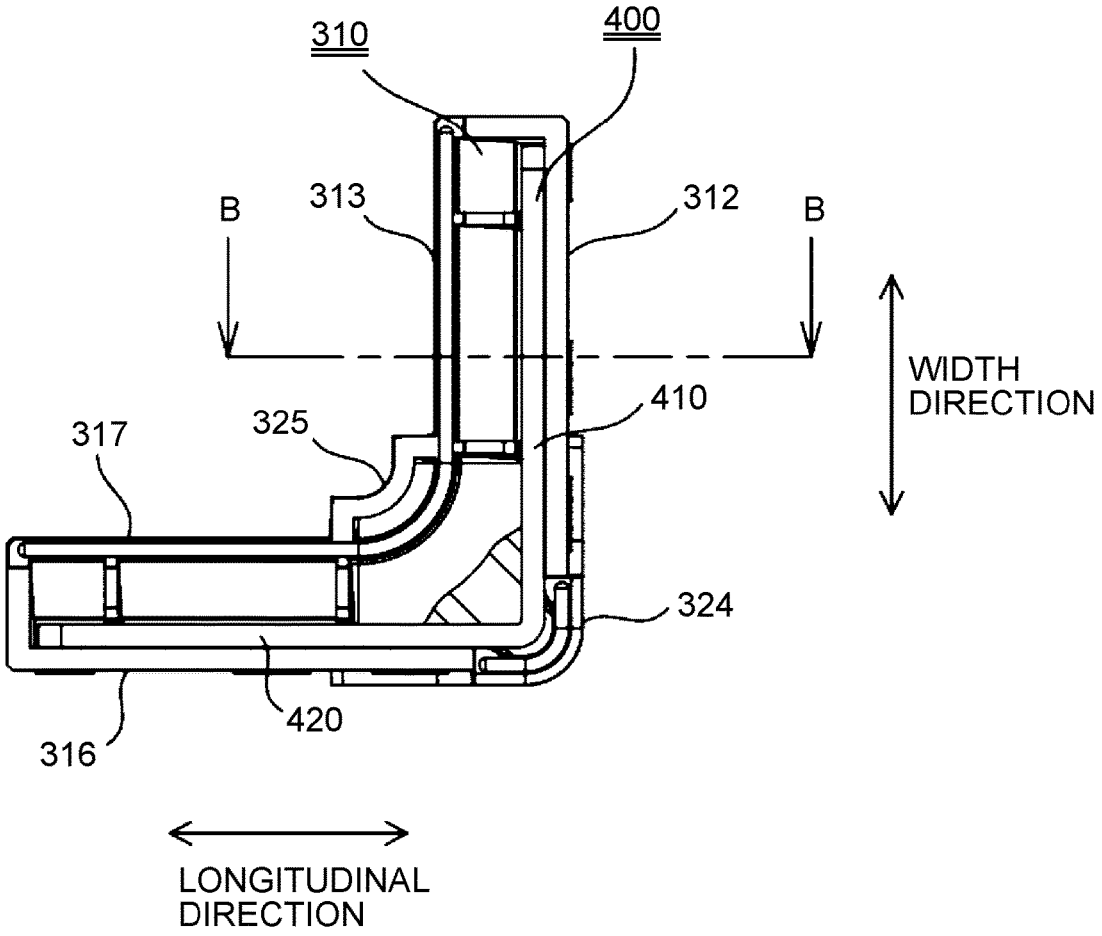
FIG. 5 is a bottom view of the corner.
Figure 6:
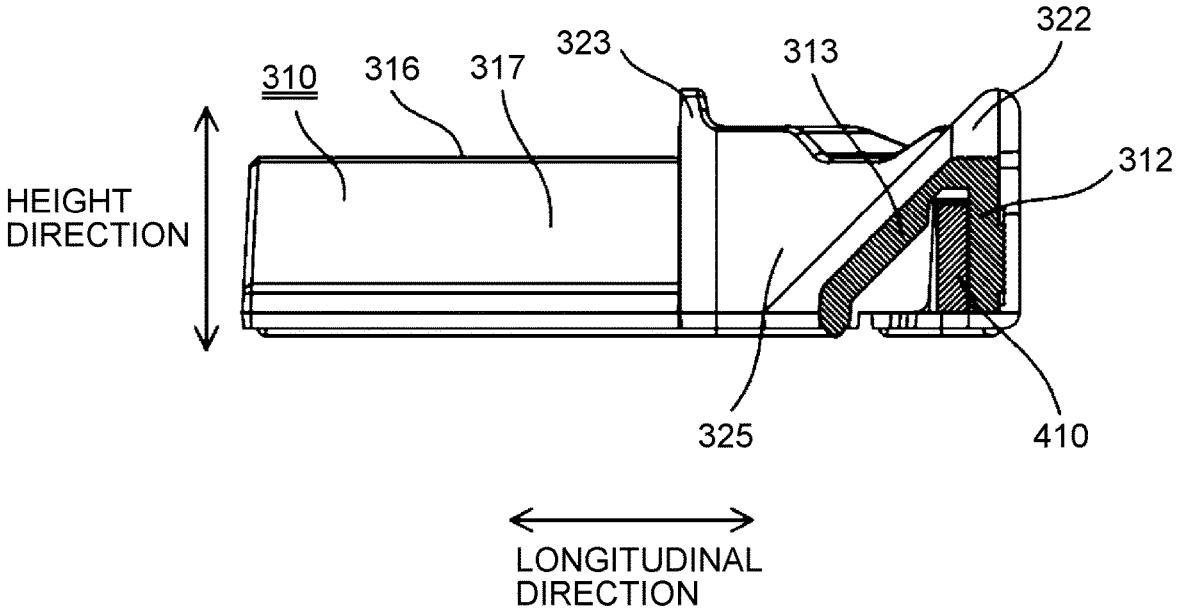
FIG. 6 is a cross-sectional view of the corner taken along line B-B of FIG. 5.

Referring to FIGS. 4, 5, and 6, the structures of the corners 310, 330, 350, and 370 will be described in detail. The corners 310, 330, 350, and 370 are molded from a non-magnetic material, such as plastic. Since the corners 310, 330, 350, and 370 have the same structure, the corner 310 will be representatively described. Herein, a longitudinal direction, a width direction, and a height direction of the corner 310 are defined, based on a longer length of the corner 310, as shown by arrows in FIG. 4.

As shown in FIG. 4, the corner 310 is substantially L-shaped. As shown in FIG. 6, the corner 310 has a substantially right triangle cross-section. As shown in FIG. 4, the corner 310 includes arm portions 311 and 315 and a third connecting portion 321. The arm portion 311 extends linearly in the width direction. The arm portion 311 includes side plates 312 and 313. The side plate 312 is a flat portion extending in the height direction and in the width direction. The side plate 312 has two holes formed therethrough in the longitudinal direction. The side plate 313 is a flat portion inclined by 45 degrees relative to the height direction and extending in the width direction. One side of the side plate 312 in the height direction is connected to one side of the side plate 313 in the height direction. The arm portion 315 extends linearly in the longitudinal direction. The arm portion 315 includes side plates 316 and 317. The side plate 316 is a flat portion extending in the height direction and in the longitudinal direction. The side plate 316 has two holes formed therethrough in the width direction. The side plate 317 is a flat portion inclined by 45 degrees relative to the height direction and extending in the longitudinal direction. The side plate 316 is connected, on its one side in the height direction, to one side in the height direction of the side plate 317. The third connecting portion 321 is arcuate. The third connecting portion 321 includes flanges 322 and 323. The flange 322 is located on one side of the third connecting portion 321 in the width direction. The flange 322 is connected to the arm portion 311. The flange 322 protrudes relative to the arm portion 311 in the height direction and in the longitudinal direction. The flange 323 is located on one side of the third connecting portion 321 in the longitudinal direction. The flange 323 is connected to the arm portion 315. The flange 323 protrudes relative to the arm portion 315 in the height direction and in the width direction. An outer surface of the third connecting portion 321 includes curved surfaces 324 and 325. The curved surface 324 extends in parallel with the height direction and is bent in the longitudinal direction and in the width direction. The curved surface 325 extends in a direction inclined by 45 degrees relative to the height direction and is bent in the longitudinal direction and in the width direction. As shown in FIG. 5, the corner 310 has therein a space for a stop plate 400.

The stop plate 400 is made of a non-magnetic material, such as stainless steel. As shown in FIG. 5, the stop plate 400 is substantially L-shaped. The stop plate 400 is formed by bending a flat plate made of a non-magnetic material. The stop plate 400 includes two side plates 410 and 420. The side plate 410 is a flat portion extending in the height direction and in the width direction. The side plate 410 has two screw holes formed therethrough in the longitudinal direction. The side plate 420 is a flat portion extending in the height direction and in the longitudinal direction. The side plate 420 has two screw holes formed therethrough in the width direction. One side of the side plate 410 in the width direction is connected to one side of the side plate 420 in the longitudinal direction. As shown in FIG. 6, the side plate 410 of the stop plate 400 is disposed between the side plate 312 and the side plate 313 so as to be parallel to the side plate 312 of the corner 310. The side plate 420 is disposed between the side plate 316 and the side plate 317 so as to be parallel to the side plate 316 of the corner 310.

Assembly of Frame Body 2

Referring to FIGS. 1 and 2, assembly of the frame body 2 will be described. Two fixing steps are executed to fix the frame sides 210, 220, 230, and 240 to the corners 310, 330, 350, and 370. The two fixing steps may be executed manually or using an exclusive assembly unit.

The first fixing step is executed for fixing the frame side 210 to the corner 310, for fixing the frame side 210 to the corner 330, for fixing the frame side 220 to the corner 350, for fixing the frame side 230 to the corner 350, for fixing the frame side 230 to the corner 370, and for fixing the frame side 240 to the corner 370. Fixing the frame side 210 to the corner 310 will be representatively described. As shown in FIG. 2, the frame side 210 and the corner 310 are placed such that the two holes of the side plate 211 of the frame side 210 respectively communicate with the two holes of the side plate 316 of the corner 310, and with the two screw holes of the side plate 420 of the stop plate 400. The two screws 390 are respectively threadedly engaged with the two screw holes of the side plate 420 while respectively inserted into the two holes of the side plate 211 and into the two holes of the side plate 316. Upon threaded engagement of the two screws 390, the second holding surface 214 of the frame side 210 is flush with the curved surface 325 of the corner 310, and the frame side 210 is fixed to the corner 310 in a state where a right end face of the frame side 210 is in contact with the flange 323.

The second fixing step is executed for fixing the frame side 220, the corner 330, and the attachment 10 to each other, and for fixing the frame side 240, the corner 310, and the attachment 10 to each other. Fixing the frame side 240, the corner 310, and the attachment 10 to each other will be representatively described. The frame side 240 and the corner 310 are placed in a similar manner for placing the frame side 210 and the corner 310. Thereafter, as shown in FIG. 2, the attachment 10 is placed such that the two holes of the side plate 122 of the attachment 10 respectively communicate with the two holes of the side plate 241 of the frame side 240, with the two holes of the side plate 312 of the corner 310, and with the two screw holes of the side plate 410 of the stop plate 400. The two screws 392 are respectively threadedly engaged with the two screw holes of the side plate 410 while respectively inserted into the two holes of the side plate 241 and into the two holes of the side plate 312. Upon threaded engagement of the two screws 392, the second holding surface 244 of the frame side 240 is flush with the curved surface 325 of the corner 310, and the frame side 220, the corner 310, and the attachment 10 are fixed to each other in a state where a rear end face of the frame side 240 is in contact with the flange 322.

Upon fixing the frame sides 210, 220, 230, and 240 to the corners 310, 330, 350, and 370, as shown in FIG. 2, the second holding surfaces 214, 224, 234, and 244 and the curved surfaces 325, 345, 365, and 385 define an inner area A1 having a substantially rectangular shape. The inner area A1 extends in the front-rear direction and in the left-right direction. The inner area A1 has an area surface P1 extending in the front-rear direction and in the left-right direction. The first holding surfaces 212, 222, 232, and 242 are located outside the second holding surfaces 214, 224, 234, and 244 in an outward direction away from the inner area A1. For example, the first holding surface 212 is located further to the rear, i.e., more outward, than the second holding surface 214. The first holding surfaces 212, 222, 232, and 242, and the second holding surfaces 214, 224, 234, and 244 extend, respectively, in two different directions crossing the area surface P1. For example, the area surface P1 is parallel to the longitudinal direction and the width direction of the frame side 210. Thus, as shown in FIG. 3, the first holding surface 212 extends in the height direction orthogonal to the area surface P1, and the second holding surface 214 extends in a direction inclined by 45 degrees relative to the area surface P1.

Structure of Holder 3

Figure 7:
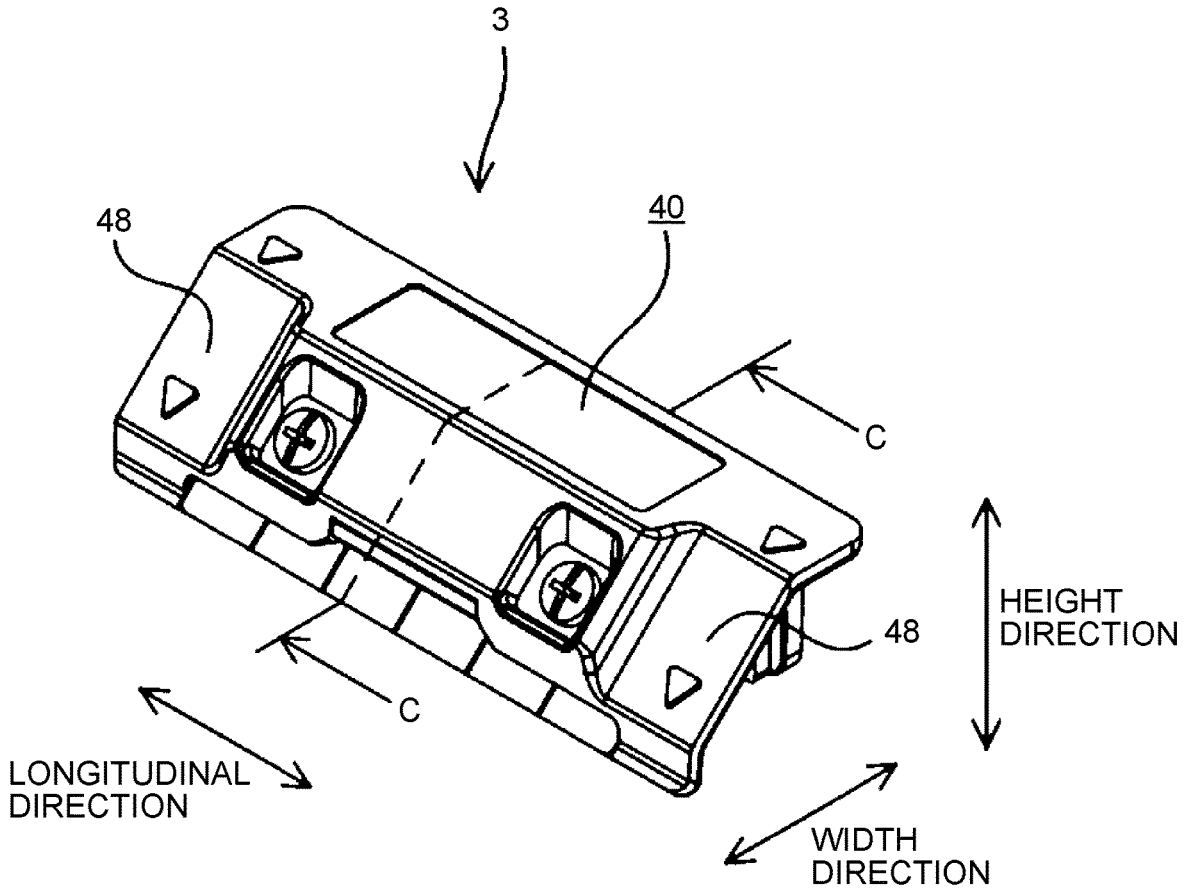
FIG. 7 is a perspective view of a holder of the holding frame.
Figure 8:
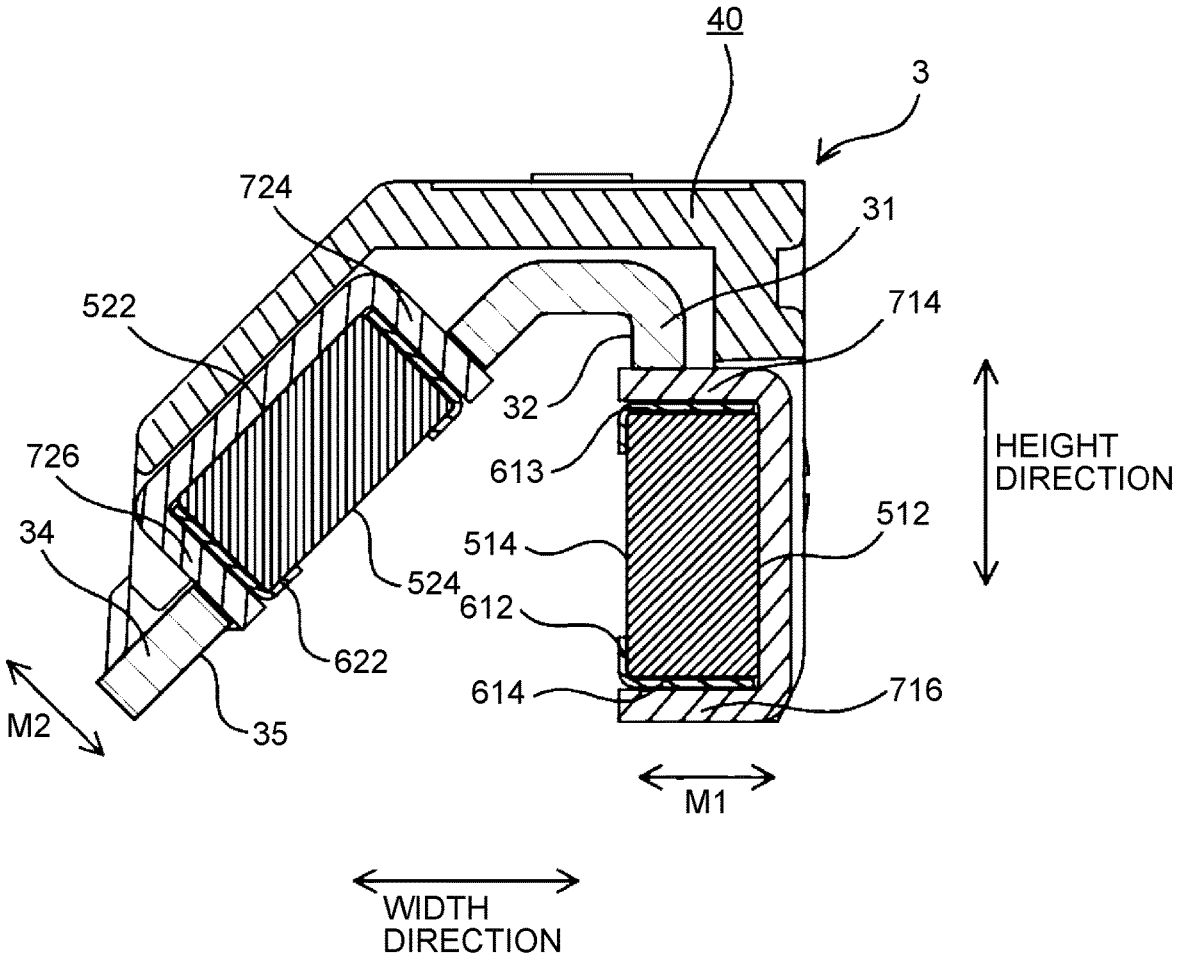
FIG. 8 is a cross-sectional view of the holder taken along line C-C of FIG. 7.
Figure 9:
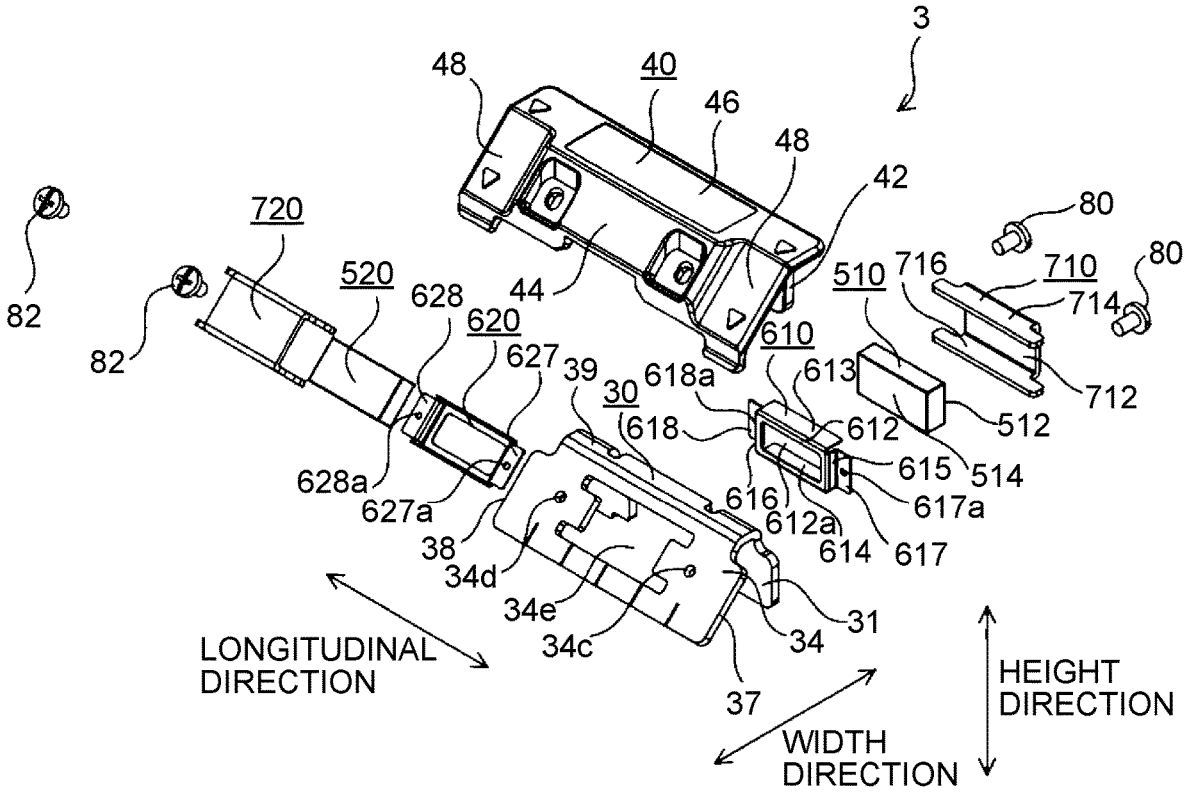
FIG. 9 is an exploded perspective view of the holder.

Referring to FIGS. 7 to 11, the structure of the holder 3 will be described in detail. As shown in FIG. 9, the holder 3 includes an inner wall 30, an exterior portion 40, magnets 510 and 520, magnet frames 610 and 620, and yokes 710 and 720. For clarity of illustration, hatching of the inner wall 30 is omitted from FIG. 11. Herein, a longitudinal direction, a width direction, and a height direction of the holder 3 are defined, based on a longer length of the holder 3, as shown by arrows in FIG. 7.

Structure of Inner Wall 30

Figure 10:
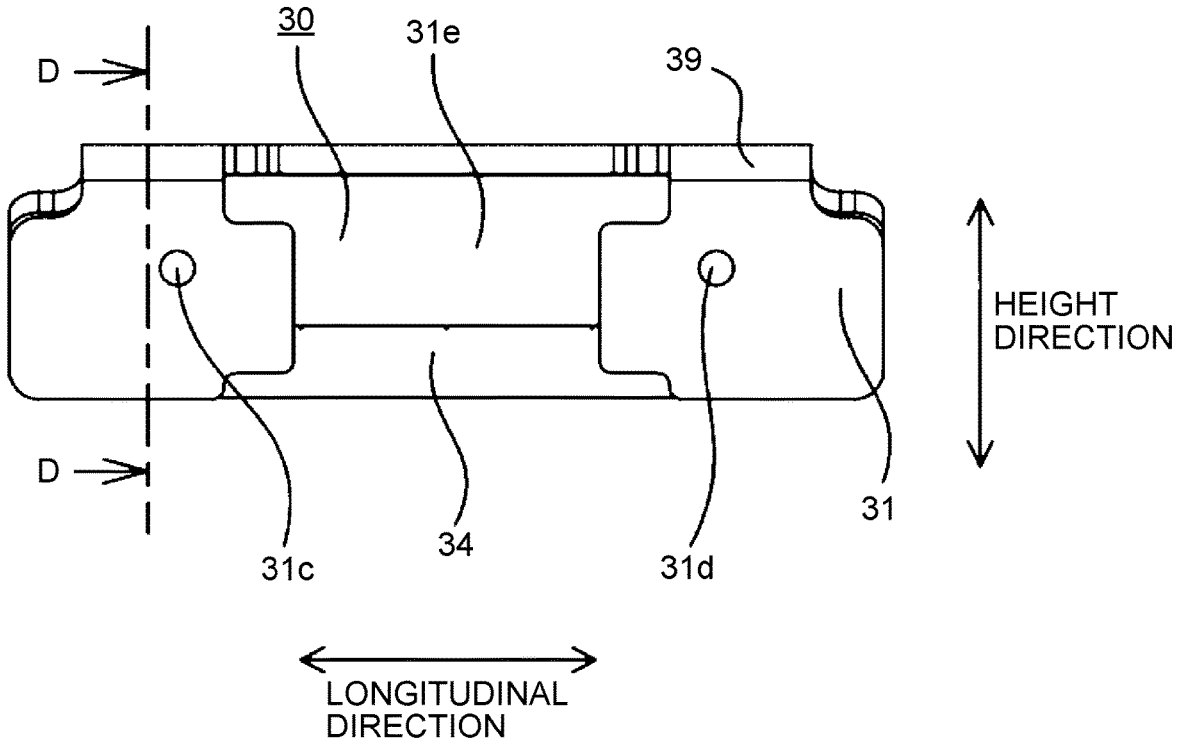
FIG. 10 is a rear view of an inner wall of the holder when viewed in a width direction.
Figure 11:
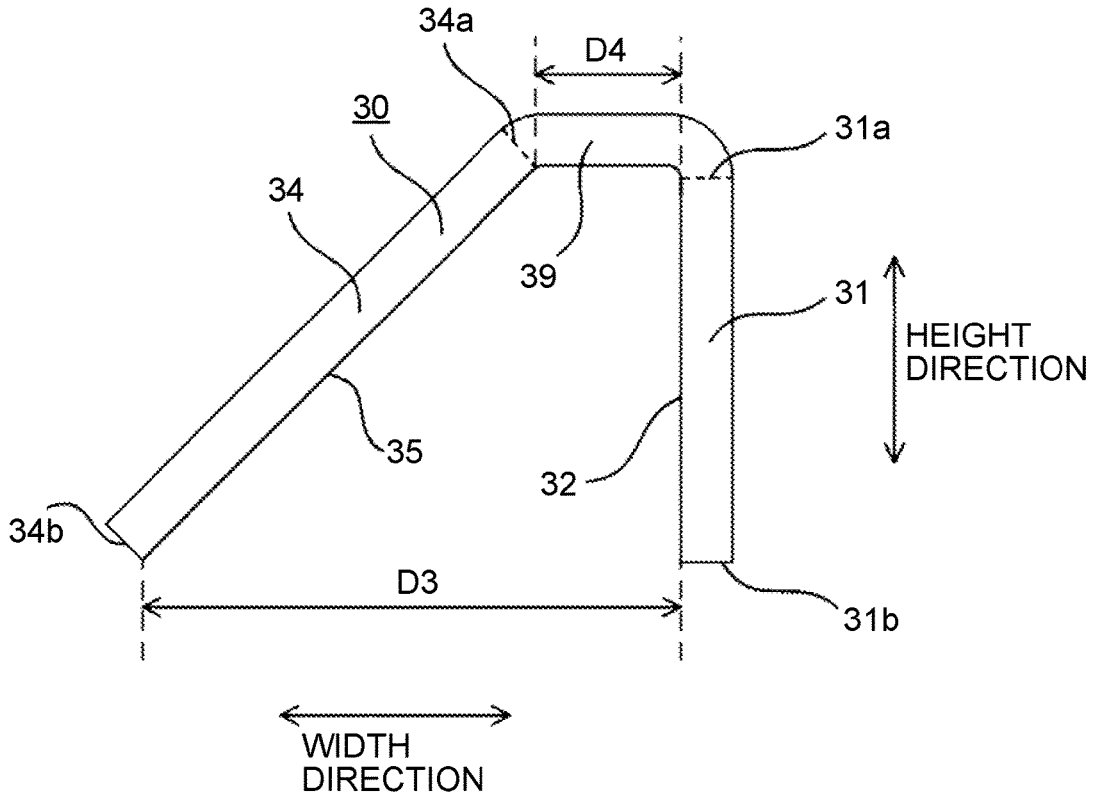
FIG. 11 is a cross-sectional view of the inner wall taken along line D-D of FIG. 10.

The inner wall 30 is made of a non-magnetic material, such as aluminum. As shown in FIG. 11, the inner wall 30 has a substantially V-shaped cross-section. The inner wall 30 is formed by bending a flat plate made of a non-magnetic material. The inner wall 30 includes a first holding portion 31, a second holding portion 34, and a second connecting portion 39. The first holding portion 31 is a flat portion extending in the height direction and in the longitudinal direction. The first holding portion 31 includes a third portion 31*a*, a third end 31*b*, and an inner surface 32. The third portion 31*a* is located on one side of the first holding portion 31 in the height direction. The third end 31*b* is an end located on the other side of the first holding portion 31 in the height direction. Namely, the third end 31*b* and the third portion 31*a* are located on opposite sides of the first holding portion 31 in the height direction. As shown in FIG. 10, the first holding portion 31 has two screw holes 31*c* and 31*d* formed therethrough in the width direction. The first holding portion 31 has an opening 31*e* formed between the two screw holes 31*c* and 31*d*. The inner surface 32 extends in the height direction and in the longitudinal direction. As shown in FIG. 11, the second holding portion 34 is a flat portion inclined by 45 degrees relative to the width direction and extending in the longitudinal direction. Namely, in the first illustrative embodiment, an angle formed by the first holding portion 31 and the second holding portion 34 is set to 45 degrees. When the holding frame 1 holds a fabric 4, the first holding portion 31 and the second holding portion 34 which form an acute angle therebetween allow the holder 3 to shift upward relative to the frame body 2. This provides a gap between the holder 3 and the frame body 2, depending on the thickness of the fabric 4, and enables the holding frame 1 to hold the fabric 4. The holding frame 1 holds the fabric 4 in a bent manner. This reduces sliding of the fabric 4 between the holder 3 and the holder body 2 when the fabric 4 held therebetween is pulled. The second holding portion 34 includes a fourth portion 34*a*, a fourth end 34*b*, an inner surface 35, and side surfaces 37 and 38. The fourth portion 34*a* is located on one side of the second holding portion 34 in the height direction. The fourth end 34*b* is an end located on the other side of the second holding portion 34 in the height direction. Namely, the fourth end 34*b* and the fourth portion 34*a* are located on opposite sides of the second holding portion 34 in the height direction. The inner surface 35 is inclined by 45 degrees relative to the width direction and extends in the longitudinal direction. As shown in FIG. 9, the second holding portion 34 has two screw holes 34*c* and 34*d* formed therethrough in a direction perpendicular to the inner surface 35. The second holding portion 34 has an opening 34*e* formed between the two screw holes 34*c* and 34*d*. As shown in FIG. 9, the side surfaces 37 and 38 are located at opposite ends of the second holding portion 34 in the longitudinal direction and extend in the height direction and in the width direction. As shown in FIG. 11, the second connecting portion 39 is arcuate. A portion on one side of the second connecting portion 39 in the width direction is connected to the third portion 31*a* of the first holding portion 31. A portion on the other side of the second connecting portion 39 in the width direction is connected to the fourth portion 34*a* of the second holding portion 34. As shown in FIG. 11, the inner wall 30 has a substantially V-shaped cross-section, and thus a distance D3 between the inner surface 32 at the third end 31*b* and the inner surface 35 at the fourth end 34*b* is greater than a distance D4 between the inner surface 32 at the third portion 31*a* and the inner surface 35 at the fourth portion 34*a*. The distance D4 is greater than the distance D2, shown in FIG. 3, between the first portion 212*a* and the second portion 214*a*.

Structure of Exterior Portion 40

The exterior portion 40 is molded from a non-magnetic material, such as plastic. As shown in FIG. 8, the exterior portion 40 has a substantially V-shaped cross-section. As shown in FIG. 9, the exterior portion 40 includes side plates 42 and 44, an upper plate 46, and grips 48. The side plate 42 extends in the height direction and in the longitudinal direction. The side plate 42 has two holes formed therethrough in the width direction. The side plate 44 is inclined by 45 degrees relative to the width direction and extends in the longitudinal direction. The side plate 44 has two holes formed therethrough in a direction perpendicular to a surface of the side plate 44. The upper plate 46 extends in the width direction and in the longitudinal direction. One side of the upper plate 46 in the width direction is connected to one side of the side plate 42 in the height direction. The other side of the upper plate 46 in the width direction is connected to one side of the side plate 44 in the height direction. The grips 48 are each formed to extend from the side plate 44 and the upper plate 46 in the longitudinal direction and to protrude beyond the side plate 42 in the longitudinal direction.

Structures of Magnets 510 and 520

The magnets 510 and 520 each are a permanent magnet, such as a Neodymium magnet. Since the magnets 510 and 520 have the same structure, the magnet 510 will be representatively described. As shown in FIG. 9, the magnet 510 has a substantially rectangular parallelepiped shape. The magnet 510 includes two surfaces 512 and 514 which have the greatest area among six surfaces. As shown in FIG. 8, the magnet 510 generates a magnetic field M1 in a direction perpendicular to the surfaces 512 and 514.

The magnet 520 generates a magnetic field M2 in a direction perpendicular to the surfaces 522 and 524.

Structures of Magnet Frames 610 and 620

The magnet frames 610 and 620 each are made of a non-magnetic material, such as stainless steel. Since the magnet frames 610 and 620 have the same structure, the magnet frame 610 will be representatively described. The magnet frame 610 has a substantially rectangular parallelepiped shape in plan view. The magnet frame 610 is formed by bending a flat plate made of a non-magnetic material. As shown in FIG. 9, the magnet frame 610 includes a base 612, side plates 613, 614, 615, and 616, and fixtures 617 and 618.

As shown in FIG. 9, the base 612 is a flat portion having a substantially rectangular shape. The base 612 has a greater length in the longitudinal direction than the magnet 510. The base 612 has a greater length in the height direction than the magnet 510. The base 612 has a hole 612*a* formed therethrough in the width direction. The hole 612*a* has a smaller length in the longitudinal direction than the magnet 510. The hole 612*a* has a smaller length in the height direction than the magnet 510. The side plates 613 and 614 each are a flat portion extending in the width direction and in the longitudinal direction. One side of the side plate 613 in the width direction is connected to one side of the base 612 in the height direction. One side of the side plate 614 in the width direction is connected to the other side of the base 612 in the height direction. The side plates 615 and 616 each are a flat portion extending in the width direction and in the height direction. One side of the side plate 615 in the width direction is connected to one side of the base 612 in the longitudinal direction. One side of the side plate 616 in the width direction is connected to the other side of the base 612 in the longitudinal direction. The fixtures 617 and 618 each are a flat portion extending in the longitudinal direction and in the height direction. The fixture 617 has a hole 617*a* formed therethrough in the width direction. One side of the fixture 617 in the longitudinal direction is connected to the other side of the side plate 615 in the width direction. The fixture 618 has a hole 618*a* formed therethrough in the width direction. One side of the fixture 618 in the longitudinal direction is connected to the other side of the side plate 616 in the width direction.

Structures of Yokes 710 and 720

The yokes 710 and 720 each are made of a magnetic material and may be a steel plate. Since the yokes 710 and 720 have the same structure, the yoke 710 will be representatively described. As shown in FIG. 9, the yoke 710 is substantially U-shaped. The yoke 710 is formed by bending a flat plate made of a magnetic material. The yoke 710 includes a bottom plate 712 and side plates 714 and 716. The bottom plate 712 is a flat portion having a substantially rectangular shape. The bottom plate 712 has a greater length in the longitudinal direction than the magnet 510. The bottom plate 712 has a greater length in the height direction than the magnet frame 610. The side plates 714 and 716 each are a flat portion extending in the width direction and in the longitudinal direction. One side of the side plate 714 in the width direction is connected to one side of the bottom plate 712 in the height direction. One side of the side plate 716 in the width direction is connected to the other side of the bottom plate 712 in the height direction.

Assembly of Holder 3

Referring to FIG. 9, assembly of the holder 3 will be described. The magnet 510 is inserted between the side plates 613, 614, 615, and 616 of the magnet frame 610 while oriented such that the surface 514 faces the base 612 of the magnet frame 610. After insertion of the magnet 510 into the magnet frame 610, the magnet 510 and the magnet frame 610 are inserted between the side plates 714 and 716 of the yoke 710 while oriented such that the surface 512 of the magnet 510 faces the bottom plate 712 of the yoke 710. After insertion of the magnet 510 and the magnet frame 610 into the yoke 710, the magnet 510, the magnet frame 610, and the yoke 710 are inserted into the opening 31*e* such that the holes 617*a* and 618*a* of the fixtures 617 and 618 of the magnet frame 610 respectively communicate with the screw holes 31*c* and 31*d* of the first holding portion 31 of the inner wall 30. The second holding portion 34, the magnet 520, the magnet frame 620, and the yoke 720 are attached to each other in a similar manner for attaching the first holding portion 31, the magnet 510, the magnet frame 610, and the yoke 710. Subsequently, the exterior portion 40 is placed on the inner wall 30 such that the two holes of the side plate 42 respectively communicate with the holes 617*a* and 618*a* of the fixtures 617 and 618 of the magnet frame 610, and with the screw holes 31*c* and 31*d* of the first holding portion 31, and that the two holes of the side plate 44 respectively communicate with the holes 627*a* and 628*a* of the fixtures 627 and 628 of the magnet frame 620, and with the screw holes 34*c* and 34*d* of the second holding portion 34. Two screws 80 are respectively threadedly engaged with the two screw holes 31*c* and 31*d* of the first holding portion 31 while respectively inserted into the two holes of the side plate 42 and into the holes 617*a* and 618*a* of the fixtures 617 and 618. Two screws 82 are respectively threadedly engaged with the two screw holes 34*c* and 34*d* of the second holding portion 34 while respectively inserted into the two holes of the side plate 44 and into the holes 627*a* and 628*a* of the fixtures 627 and 628. Upon threaded engagement, the inner wall 30, the exterior portion 40, the magnets 510 and 520, the magnet frames 610 and 620, and the yokes 710 and 720 are fixed to each other.

As shown in FIG. 8, when the holder 3 is assembled as described above, the surface 514 of the magnet 510, the base 612 of the magnet frame 610, and ends of the side plates 714 and 716 of the yoke 710 are exposed from the inner surface 32 of the first holding portion 31. The surface 524 of the magnet 520, the base 622 of the magnet frame 620, and ends of the side plates 724 and 726 of the yoke 720 are exposed from the inner surface 35 of the second holding portion 34. The surfaces 512 and 514 of the magnet 510 are parallel to the inner surface 32 of the first holding portion 31, and thus the direction of the magnetic field M1 of the magnet 510 is orthogonal to the inner surface 32. The surfaces 522 and 524 of the magnet 520 are parallel to the inner surface 35 of the second holding portion 34, and thus the direction of the magnetic field M2 of the magnet 520 is orthogonal to the inner surface 35. The inner wall 30 has a substantially V-shaped cross-section. Thus, the inner surface 32 of the first holding portion 31 is not parallel to the inner surface 35 of the second holding portion 34, and the direction of the magnetic field M1 of the magnet 510 is different from that of the magnetic field M2 of the magnet 520. The grips 48 of the exterior portion 40 are disposed on the second holding portion 34 to protrude from the side surfaces 37 and 38 of the inner wall 30.

Operation and Action of Holding Frame 1

Figure 12:
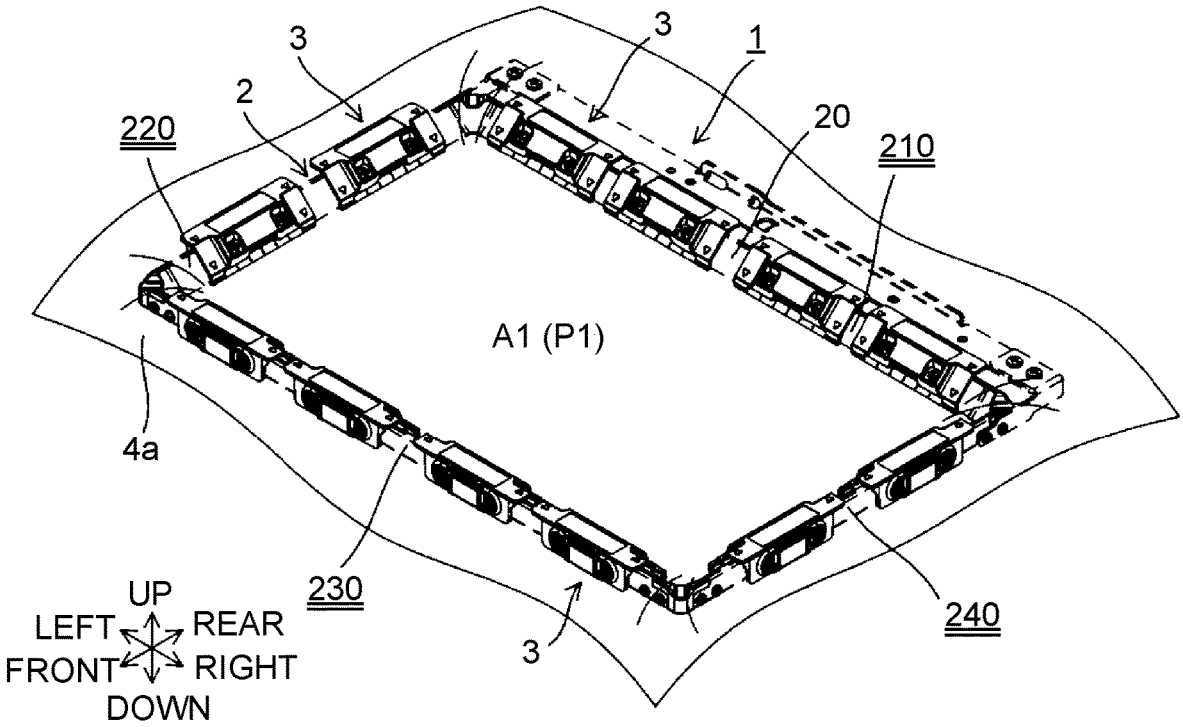
FIG. 12 is a perspective view of the holding frame with a fabric attached using a plurality of holders.
Figure 13:
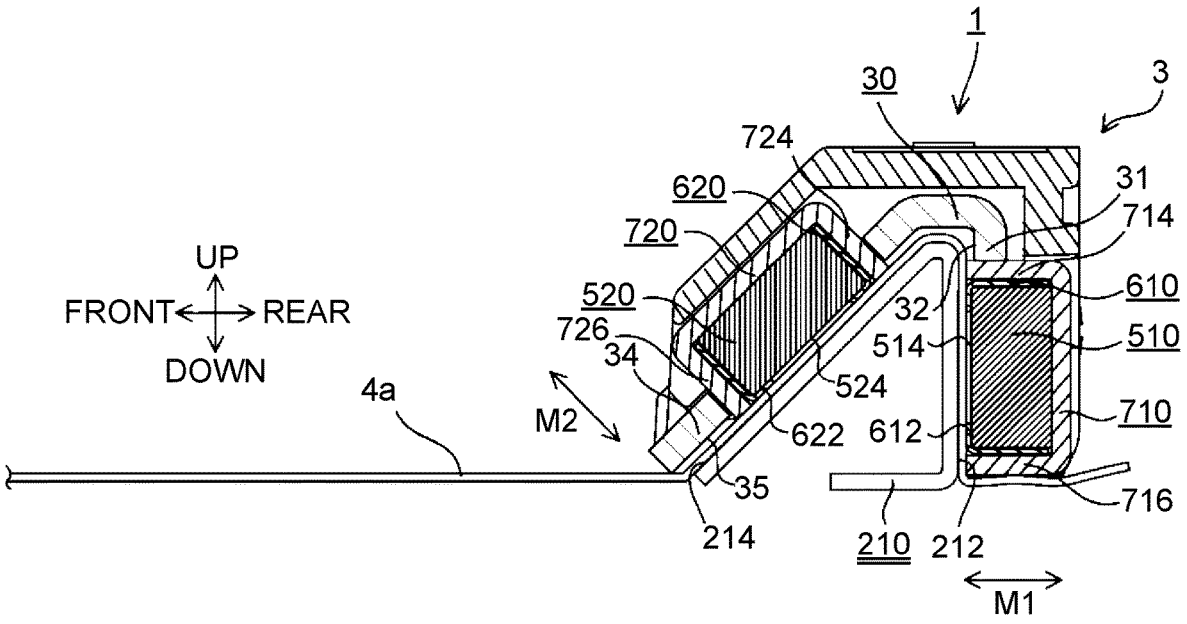
FIG. 13 is a cross-sectional view of the frame side and the holder in the holding frame with a thin fabric attached.
Figure 14:
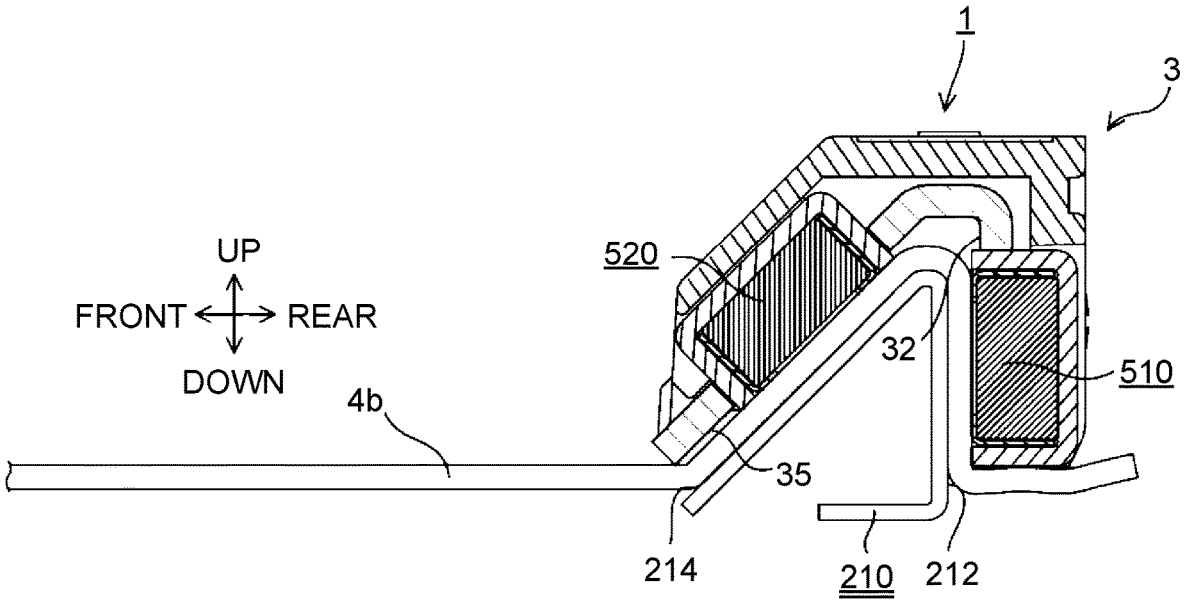
FIG. 14 is a cross-sectional view of the frame side and the holder in the holding frame with a thick fabric attached.

Referring to FIGS. 12 to 14, operation and action of the holding frame 1 structured as described above will be described. For clarity of illustration, hatching for the cross-sections of the frame side 210 and fabrics 4*a* and 4*b* is omitted from FIGS. 13 and 14.

Attachment of Fabric 4 to Holding Frame 1

In a state where the holders 3 are removed from the frame body 2, a user places a thin fabric 4*a* on the frame forming portion 20 such that a sewing area of the fabric 4*a* is located within the inner area A1 of the frame forming portion 20. The sewing area is an area where the user desires to sew in the fabric 4*a*. After placing the fabric 4*a* on the frame forming portion 20, as shown in FIG. 12, the user attaches, from above the fabric 4*a*, one or more holders 3 to each of the frame sides 210, 220, 230, and 240. In other words, the user attaches to the frame forming portion 20 as many holders 3 as or more holders 3 than the number of frame sides 210, 220, 230, and 240. Since the attaching orientation of a holder 3 to any of the frame sides 210, 220, 230, and 240 is the same, the attaching orientation of a holder 3 to the frame side 210 will be representatively described referring to FIG. 13. In the holder 3, the inner surface 32 of the first holding portion 31, the surface 514 of the magnet 510, the base 612 of the magnet frame 610, and the ends of the side plates 714 and 716 of the yoke 710 face the first holding surface 212 of the frame side 210, via the fabric 4*a*. In the holder 3, the inner surface 35 of the second holding portion 34, the surface 524 of the magnet 520, the base 622 of the magnet frame 620, and the ends of the side plates 724 and 726 of the yoke 720 face the second holding surface 214 of the frame side 210, via the fabric 4*a*. Since the frame side 210 is made of a magnetic material, a magnetic force is generated between the magnet 510 and the first holding surface 212 to attract each other, and between the magnet 520 and the second holding surface 214 to attract each other. As shown in FIG. 12, the frame forming portion 20 and the holders 3 securely hold the fabric 4*a* due to magnetic forces between the magnets 510 and 520 and the frame sides 210, 220, 230, and 240.

As shown in FIG. 12, the fabric 4*a* is stretched taut in the front-rear direction and in the left-right direction in a state where the frame forming portion 20 and one or more holders 3 hold the fabric 4*a*. Since the inner area A1 and the area surface P1 extend in the front-rear direction and in the left-right direction, the stretched fabric 4*a* is parallel to the area surface P1. At this time, as shown in FIG. 13, the first holding surface 212 faces the first holding portion 31, and the second holding surface 214 faces the second holding portion 34. Thus, the first holding portion 31 and the second holding portion 34 extend in two different directions crossing the area surface P1. Specifically, the first holding portion 31 extends in the up-down direction, orthogonally to the area surface P1, and the second holding portion 34 extends in a direction inclined by 45 degrees relative to the area surface P1.

Attachment of a thick fabric 4*b* to the holding frame 1 is executed in a similar manner for attachment of a thin fabric 4*a* to the holding frame 1, and thus a description thereof will be omitted. When a thick fabric 4*b* is attached to the holding frame 1, the orientation of a holder 3 attached to any of the frame sides 210, 220, 230, and 240 is the same. Thus, the attaching orientation of a holder 3 to the frame side 210 will be representatively described referring to FIG. 14. As in a case for holding a thin fabric 4*a*, the holding frame 1 holds a thick fabric 4*b* such that the frame side 210 faces the holder 3. However, the holder 3 is shifted, relative to the frame side 210, more upward by the thickness of the fabric 4*b* than when the holding frame 1 holds a thin fabric 4*a*. Accordingly, a gap between the first holding surface 212 and the inner surface 32 and a gap between the second holding surface 214 and the inner surface 35 increase. Even when these gaps increase, a magnetic force is generated between the magnet 510 and the first holding surface 212 to attract each other, and between the magnet 520 and the second holding surface 214 to attract each other, enabling the frame forming portion 20 and the holder 3 to securely hold the thick fabric 4*b*.

Removal of Fabric 4 from Holding Frame 1

In order to remove the fabric 4*a* from the holding frame 1, the user removes all the holders 3 from the frame sides 210, 220, 230, and 240 to release the fabric 4*a* from the frame forming portion 20 and the holders 3. Since removal of the holders 3 from the frame sides 210, 220, 230, and 240 is executed in the same manner, removal of a holder 3 from the frame side 210 will be representatively described. The user holds the grips 48 of the holder 3 shown in in FIG. 7 in a state where the side frame 210 and the holder 3 hold the fabric 4*a* as shown in FIG. 13. After holding the grips 48, in a state where the inner surface 32 of the first holding portion 31 faces the first holding surface 212 of the frame side 210, the user moves the inner surface 32 upward along the first holding surface 212 to remove the holder 3 from the frame side 210. Alternatively, in a state where the inner surface 35 of the second holding portion 34 faces the second holding surface 214 of the frame side 210, the user moves the inner surface 35 upward along the second holding surface 214 to remove the holder 3 from the frame side 210.

Direct Attachment of Holder 3 to Frame Body 2

In some cases, the user directly attaches one or more holders 3 to each of the frame sides 210, 220, 230, and 240 of the frame forming portion 20. Since the attaching orientation of a holder 3 to any of the frame sides 210, 220, 230, and 240 is the same, the attaching orientation of a holder 3 to the frame side 210 will be representatively described. In FIG. 13, when the holder 3 is directly attached to the frame side 210 without a fabric 4*a*, the inner surface 32 of the first holding portion 31, the surface 514 of the magnet 510, the base 612 of the magnet frame 610, and the ends of the side plates 714 and 716 of the yoke 710 face the first holding surface 212 of the frame side 210. The inner surface 35 of the second holding portion 34, the surface 524 of the magnet 520, the base 622 of the magnet frame 620, and the ends of the side plates 724 and 726 of the yoke 720 face the second holding surface 214 of the frame side 210. The first holding surface 212 and the second holding surface 214 of the frame side 210 form 45 degrees therebetween, while the inner surface 32 and the inner surface 35 of the holder 3 form 45 degrees therebetween. The distance D4, shown in FIG. 11, between the inner surface 32 at the third portion 31*a* and the inner surface 35 at the fourth portion 34*a* is greater than the distance D2, shown in FIG. 3, between the first portion 212*a* and the second portion 214*a*. Accordingly, in FIG. 13, when the first holding surface 212 of the frame side 210 contacts the inner surface 32 of the holder 3, there is a gap between the second holding surface 214 of the frame side 210 and the inner surface 35 of the holder 3. Alternatively, when the second holding surface 214 of the frame side 210 contacts the inner surface 35 of the holder 3, there is a gap between the first holding surface 212 of the frame side 210 and the inner surface 32 of the holder 3.

Effects of Holding Frame 1

As shown in FIG. 2, the corners 310, 330, 350, and 370 of the frame body 2 have the same structure. Thus, as long as the frame sides 210 and 230 have the same length in their longitudinal directions and the frame sides 220 and 240 have the same length in their longitudinal directions, the longitudinal lengths of the frame sides 210, 220, 230, and 240 may be selected as desired. Consequently, the frame body 2 may have an inner area A1 different in shape and an area surface P1 different in area.

The frame sides 210, 220, 230, and 240 of the frame body 2 each have a substantially right triangle cross-section, as shown in FIG. 3. The distance D1 between the first end 212*b* and the second end 214*b* is greater than the distance D2 between the first portion 212*a* and the second portion 214*a*. The holders 3 are attached to the frame sides 210, 220, 230, and 240 each having the cross-section shown in FIG. 3. Even when the thickness varies considerably from one fabric 4 to another, the holders 3 are shiftable upward by the thickness of a fabric 4, relative to the frame sides 210, 220, 230, and 240. This provides a gap between the frame body 2 and each holder 3, depending on the thickness of the fabric 4, and enables the holders 3 and the frame sides 210, 220, 230, and 240 to hold the fabric 4 therebetween.

As shown in FIG. 11, the inner wall 30 of the holder 3 has a substantially V-shaped cross-section, and the distance D3 between the inner surface 32 at the third end 31*b* and the inner surface 35 at the fourth end 34*b* is greater than the distance D4 between the inner surface 32 at the third portion 31*a* and the inner surface 35 at the fourth end 34*a*. The holders 3 are attached to the frame sides 210, 220, 230, and 240 each having the cross-section shown in FIG. 11. Even when the thickness varies considerably from one fabric 4 to another, the holders 3 are shiftable upward by the thickness of a fabric 4, relative to the frame sides 210, 220, 230, and 240. This provides a gap between the frame body 2 and each holder 3, depending on the thickness of the fabric 4, and enables the holders 3 and the frame sides 210, 220, 230, and 240 to hold the fabric 4 therebetween.

The distance D4 between the inner surface 32 at the third portion 31*a* and the inner surface 35 at the fourth portion 34*a* of the holder 3 is greater than the distance D2 between the first portion 212*a* and the second portion 214*a* of the frame side 210. Thus, when the first holding surface 212 of the frame side 210 contacts the inner surface 32 of the holder 3, there is a gap between the second holding surface 214 of the frame side 210 and the inner surface 35 of the holder 3. Alternatively, when the second holding surface 214 of the frame side 210 contacts the inner surface 35 of the holder 3, there is a gap between the first holding surface 212 of the frame side 210 and the inner surface 32 of the holder 3. A magnetic force generated between the frame side 210 and the holder 3 to attract each other decreases when there is a gap between the frame side 210 and the holder 3 as compared when the first holding surface 212 contacts the inner surface 32 and the second holding surface 214 contacts the inner surface 35. This facilitates the user to remove the holder 3 from the frame body 2.

The holder 3 includes the grips 48. By holding the grips 48 of the holder 3, when attached to the frame body 2 as shown in FIG. 13, the user is allowed to move the holder 3 in a direction orthogonal to the magnetic fields M1 and M2, upward along the first holding surface 212, 222, 232, or 242 or the second holding surface 214, 224, 234, or 244 of the frame side 210, 220, 230, or 240. The grips 48 facilitate removal of the holder 3 from the frame body 2.

The first holding surface 212 of the frame side 210 is a plane parallel to the up-down direction. This may prevent the holder 3, when attached to the frame side 210, from interfering with the mount 100 of the sewing machine.

When the sewing machine sews in the fabric 4 held by the holding frame 1, a tension is exerted to pull the fabric 4 in a direction from outside toward inside the inner area A1. Namely, the tension is exerted on the fabric 4 in the front-rear direction and in the left-right direction in FIG. 13. The holder 3 and the frame side 210, 220, 230, or 240 having a substantially right triangle cross-section hold the fabric 4 in a bent manner. This may reduce sliding of the fabric 4 between the frame body 2 and the holder 3 when the fabric 4 held therebetween is pulled in the inner area A1.

As shown in FIG. 13, the holder 3 has a substantially V-shaped cross-section. The holder 3 having the cross-section shown in FIG. 13 and the frame side 210, 220, 230, or 240 hold the fabric 4 in a bent manner. This may reduce sliding of the fabric 4 between the frame body 2 and the holder 3 when the fabric 4 held therebetween is pulled in the inner arear A1.

In a state where the fabric 4 is held by the holding frame 1, the inner surface 32 of the first holding portion 31 of the holder 3, the surface 514 of the magnet 510, the corresponding first holding surface 212, 222, 232, or 242 of the frame side 210, 220, 230, or 240 extend in the up-down direction, as shown in FIG. 13. The magnet 510, when facing the first holding surface 212 or 232, generates a magnetic field M1 in parallel with the front-rear direction, and when facing the first holding surface 222 or 242, generates a magnetic field M1 in parallel with the left-right direction. Consequently, in a state where the fabric 4 is held by the holding frame 1, the direction of the magnetic field M1 of the magnet 510 is parallel to the direction of the tension exerted on the fabric 4. This may reduce sliding of the fabric 4 between the frame body 2 and the holder 3 when the fabric 4 held therebetween is pulled in the inner area A1.

The magnets 510 and 520 are respectively disposed at the first holding portion 31 and the second holding portion 34 of the holder 3. The first holding surface 212, 222, 232, or 242 and the first holding portion 31 attract each other due to the magnetic field M1 of the magnet 510, and the second holding surface 214, 224, 234, or 244 and the second holding portion 34 attract each other due to the magnetic field M2 of the magnet 520. This may reliably reduce sliding of the fabric 4 between the frame body 2 and the holder 3 when the fabric 4 held therebetween is pulled in the inner area A1, as compared with a case where the magnet 510 or 520 is disposed at one of the first holding portion 31 and the second holding portion 34.

As shown in FIG. 12, one or more holders 3 are attached by a user, from above the fabric 4, to each of the frame sides 210, 220, 230, and 240. This enables the holding frame 1 to hold the fabric 4 in the front-rear direction and in the left-right direction. Thus, the holding frame 1 stretches taut the fabric 4 in the inner area A1.

As shown in FIG. 13, in the holder 3, the magnets 510 and 520 are respectively disposed on the inner surface 32 of the first holding portion 31 and on the inner surface 35 of the second holding portion 34. In this case, the amount of magnet used may be reduced as compared when magnets are respectively disposed throughout the length of the frame sides 210, 220, 230, and 240, resulting in a cost reduction.

Second Illustrative Embodiment

Figure 15:
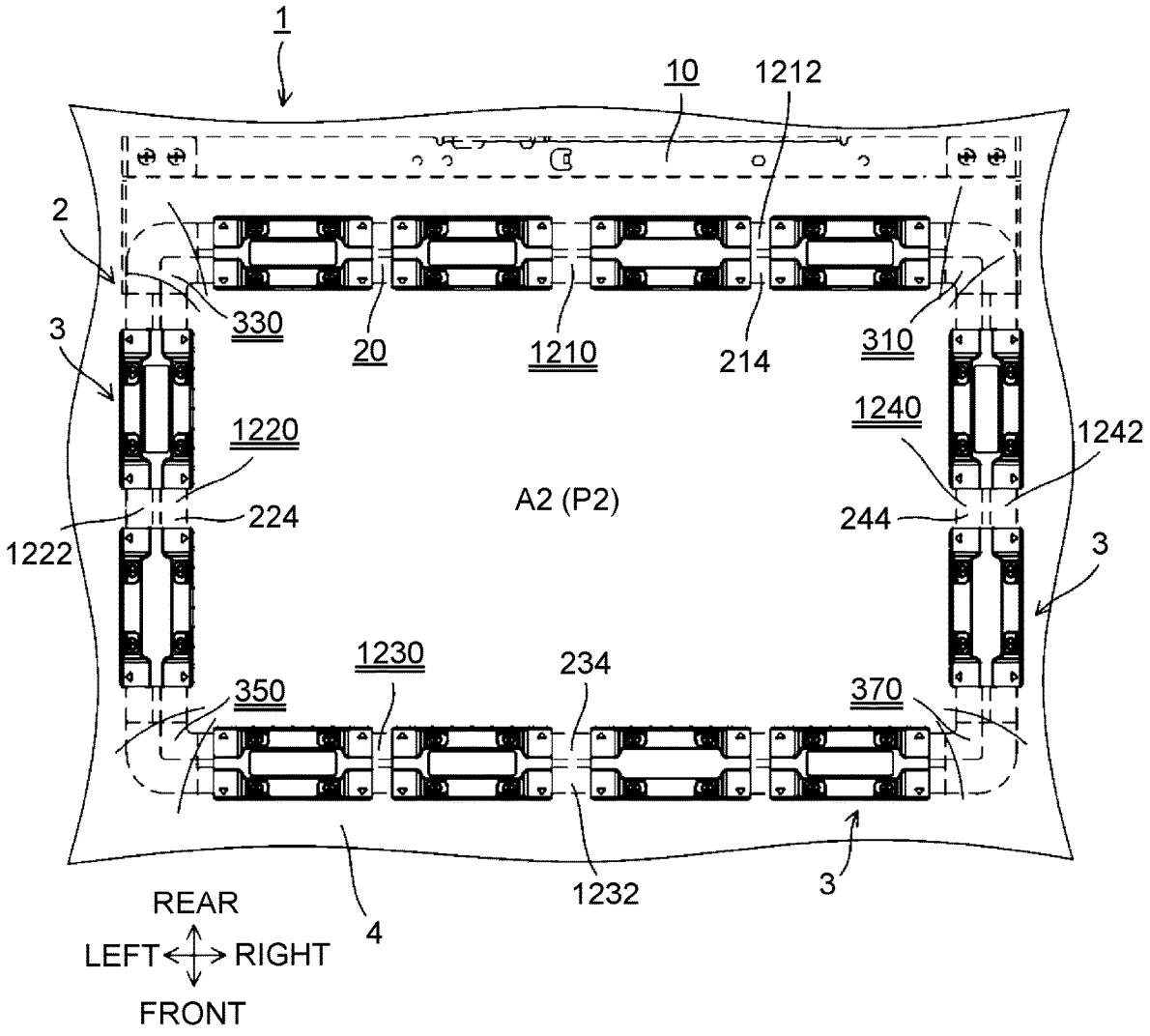
FIG. 15 is a top plan view of a holding frame with a fabric attached, according to a second illustrative embodiment.
Figure 16:
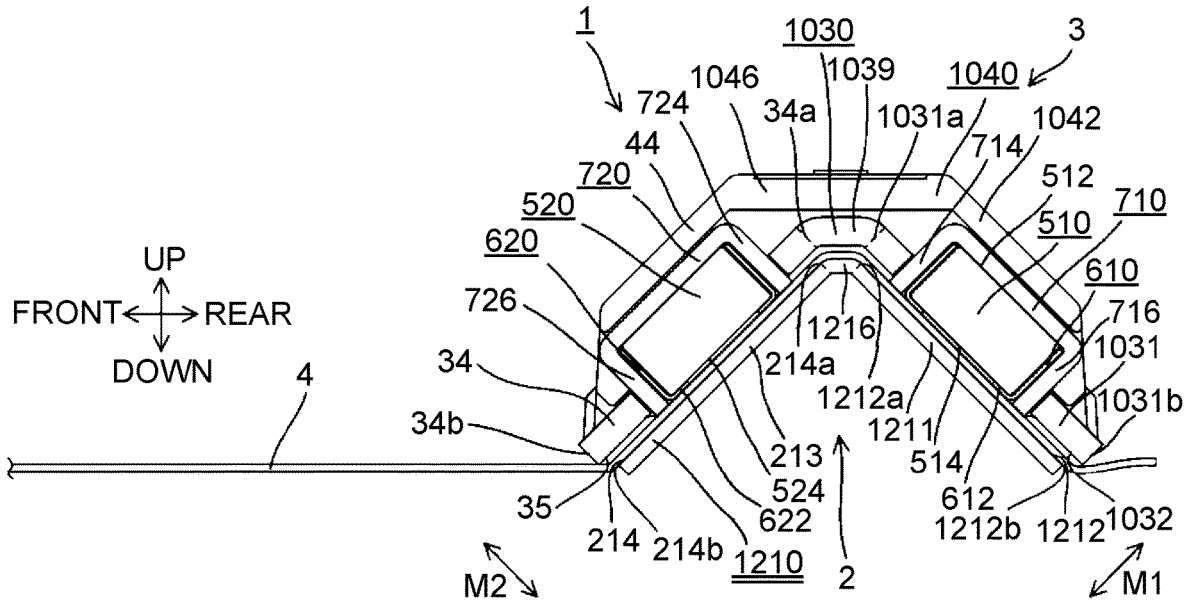
FIG. 16 is a cross-sectional view of a frame side and a holder in the holding frame with a fabric attached, according to the second illustrative embodiment.

Referring to FIGS. 15 and 16, the structure of a holding frame 1 according to a second illustrative embodiment will be described. For clarity of illustration, hatching is omitted from FIGS. 16 to 26. The second illustrative embodiment differs from the first illustrative embodiment in that a user is allowed to attach holders 3 to frame sides 1210, 1220, 1230, and 1240 without paying attention to the attaching orientation of the holders 3 to the frame sides 1210, 1220, 1230, and 1240. Hereinafter, elements different from those in the first illustrative embodiment will only be described, and the same elements as those in the first illustrative embodiment are indicated by the same reference characters.

Structure of Frame Forming Portion 20

As shown in FIG. 15, the frame forming portion 20 is substantially rectangular in plan view. The frame forming portion 20 includes four frame sides 1210, 1220, 1230, and 1240, and four corners 310, 330, 350 and 370 which have the same structure as those in the first illustrative embodiment.

Structures of Frame Sides 1210, 1220, 1230, and 1240

The frame sides 1210, 1220, 1230, and 1240 have the same structure except that their longitudinal lengths are not uniform, similarly to the frame sides 210, 220, 230, and 240 in the first illustrative embodiment. The structure of the frame side 1210, out of the frame sides 1210, 1220, 1230, and 1240, will be representatively described referring to FIG. 16. The frame side 1210 has a substantially V-shaped cross-section. The frame side 1210 has the same structure as the frame side 210 in the first illustrative embodiment except that the frame side 1210 is different in cross-sectional shape from the frame side 210. The frame side 1210 includes side plates 213 and 1211, and a first connecting portion 1216. The side plate 213 is similar in structure to the side plate 213 in the first illustrative embodiment. The side plate 1211 is a flat portion inclined by 45 degrees relative to a width direction which corresponds to a front-rear direction in FIG. 16, and extending in a longitudinal direction which corresponds to a left-right direction in FIG. 16. The side plate 1211 has the same structure as the side plate 211 in the first illustrative embodiment except that the side plate 1211 is inclined relative to the width direction. An outer surface of the side plate 1211 is a first holding surface 1212. The first holding surface 1212 includes a first portion 1212*a* and a first end 1212*b*. The first portion 1212*a* is located on one side of the first holding surface 1212 in a height direction which corresponds to an up-down direction. The first end 1212*b* is located on the other side of the first holding surface 1212 in the height direction. The first connecting portion 1216 is arcuate. A portion on one side of the first connecting portion 1216 in the width direction is connected to the first portion 1212*a* of the first holding surface 1212. A portion on the other side of the first connecting portion 1216 in the width direction is connected to the second portion 214*a* of the second holding surface 214. The frame side 1210 has a substantially V-shaped cross-section, and a distance between the first end 1212*b* and the second end 214*b* is greater than a distance between the first portion 1212*a* and the second portion 214*a*.

Assembly of Frame Body 2

A frame body 2 is assembled in a similar manner as in the first illustrative embodiment such that, as shown in FIG. 15, a frame forming portion 20 defines a substantially rectangular inner area A2. The inner area A2 extends in the front-rear direction and in the left-right direction. The inner area A2 has an area surface P2 extending in the front-rear direction and in the left-right direction. First holding surfaces 1212, 1222, 1232, and 1242 of the frame sides 1210, 1220, 1230, 1240 are located outside second holding surfaces 214, 224, 234, and 244 in an outward direction away from the inner area A2. For example, the first holding surface 1212 is located further to the rear, i.e., more outward, than the second holding surface 214. The first holding surfaces 1212, 1222, 1232, and 1242, and the second holding surfaces 214, 224, 234, and 244 respectively extend in directions inclined by 45 degrees relative to the area surface P2. An angle formed by the area surface P2 and each of the first holding surfaces 1212, 1222, 1232, and 1242 is equal to an angle formed by the area surface P2 and each of the second holding surfaces 214, 224, 234, and 244. The term "equal" indicates not only completely coincidental but also may include a meaning defined in consideration of common general technical knowledge.

Structure of Holder 3

As shown in FIG. 16, the holder 3 includes an inner wall 1030, an exterior portion 1040, magnets 510 and 520, magnet frames 610 and 620, and yokes 710 and 720. The magnets 510 and 520, the magnet frames 610 and 620, and the yokes 710 and 720 have the same structures as those in the first illustrative embodiment.

Structure of Inner Wall 1030

As shown in FIG. 16, the inner wall 1030 has a substantially V-shaped cross-section. The inner wall 1030 has the same structure as the inner wall 30 in the first illustrative embodiment except that the inner wall 1030 is different in cross-sectional shape from the inner wall 30. The inner wall 1030 includes a first holding portion 1031, a second holding portion 34, and a second connecting portion 1039. The second holding portion 34 has the same structure as the second holding portion 34 in the first illustrative embodiment. The first holding portion 1031 is a flat portion inclined by 45 degrees relative to a width direction which corresponds to the front-rear direction, and extending in a longitudinal direction which corresponds to the left-right direction. The first holding portion 1031 has the same structure as the first holding portion 31 in the first illustrative embodiment except that the first holding portion 1031 is inclined relative to the width direction. The first holding portion 1031 includes a third portion 1031*a* and a third end 1031*b*. The third portion 1031*a* is located on one side of the first holding portion 1031 in a height direction which corresponds to the up-down direction. The third end 1031*b* is located on the other side of the first holding portion 1031 in the height direction. The second connecting portion 1039 is arcuate. A portion on one side of the second connecting portion 1039 in the width direction is connected to the third portion 1031*a* of the first holding portion 1031. A portion on the other side of the second connecting portion 1039 in the width direction is connected to the fourth portion 34*a* of the second holding portion 34. The inner wall 1030 has a substantially V-shaped cross-section, and thus a distance between an inner surface 1032 at the third end 1031*b* and an inner surface 35 at the fourth end 34*b* is greater than a distance between the inner surface 1032 at the third portion 1031*a* and the inner surface 35 at the fourth portion 34*a*. The distance between the inner surface 1032 at the third portion 1031*a* and the inner surface 35 at the fourth portion 34*a* is greater than the distance between the first portion 1212*a* and the second portion 214*a*.

Structure of Exterior Portion 1040

The exterior portion 1040 has a substantially V-shaped cross-section. The exterior portion 1040 has the same structure as the exterior portion 40 in the first illustrative embodiment except that the exterior portion 1040 is different in cross-sectional shape from the exterior portion 40. As shown in FIG. 16, the exterior portion 1040 includes side plates 44 and 1042, and an upper plate 1046. The side plate 44 has the same structure as the side plate 44 in the first illustrative embodiment. The side plate 1042 is inclined by 45 degrees relative to the width direction and extends in the longitudinal direction. The side plate 1042 has the same structure as the side plate 42 in the first illustrative embodiment except that the side plate 1042 is inclined relative to the width direction. One side of the upper plate 1046 in the width direction is connected to one side of the side plate 1042 in the height direction.

Assembly of Holder 3

The holder 3 is assembled in a similar manner as in the first illustrative embodiment such that surfaces 512 and 514 of the magnet 510 are parallel to the inner surface 1032 of the first holding portion 1031. Thus, the direction of a magnetic field M1 of the magnet 510 is orthogonal to the inner surface 1032. The inner wall 1030 has a substantially V-shaped cross-section, and thus the inner surface 1032 of the first holding portion 1031 is orthogonal to the inner surface 35 of the second holding portion 34, and the direction of the magnetic field M1 of the magnet 510 fixed to the first holding portion 1031 is orthogonal to the direction of a magnetic field M2 of the magnet 520 fixed to the second holding portion 34.

Attachment of Holder 3 to Frame Body 2

Attachment of a holder 3 to the frame body 2 via a fabric 4, and direct attachment of a holder 3 to the frame body 2 may be executed in a similar manner as in the first illustrative embodiment. Alternatively, a holder 3 may be attached to the frame body 2 in an attaching orientation different from that in the first illustrative embodiment. Since the attaching orientation of a holder 3 to any of the frame sides 1210, 1220, 1230, and 1240 is the same, the attaching orientation of a holder 3 to the frame side 1210 will be representatively described. As shown in FIG. 16, the first holding surface 1212, the second holding surface 214, the first holding portion 1031, and the second holding portion 34 are inclined by the same angle of 45 degrees relative to the width direction. This allows a user to attach the holder 3 to the frame side 1210 in an attaching orientation different from that shown in FIG. 16 such that the inner surface 1032 of the first holding portion 1031, the surface 514 of the magnet 510, a base 612 of the magnet frame 610, and ends of side plates 714 and 716 of the yoke 710 face the second holding surface 214, and that the inner surface 35 of the second holding portion 34, the surface 524 of the magnet 520, a base 622 of the magnet frame 620, and ends of side plates 724 and 726 of the yoke 720 face the first holding surface 1212.

In a state where the holder 3 is attached to the frame body 2, as shown in FIG. 16, the first holding surface 1212 faces the first holding portion 1031, and the second holding surface 214 faces the second holding portion 34. The first holding portion 1031 and the second holding portion 34 respectively extend in directions inclined by 45 degrees relative to the front-rear direction which is parallel to the area surface P2. An angle formed by the area surface P2 and the first holding portion 1031 is equal to an angle formed by the area surface P2 and the second holding portion 34.

Effects of Holding Frame 1

The first holding surface 1212, 1222, 1232, and 1242, the second holding surface 214, 224, 234, and 244, the first holding portion 1031, and the second holding portion 34 are inclined by the same angle relative to the width direction. Thus, the holder 3 is attachable to the frame body 2 in such an attaching orientation that the first holding surface 1212, 1222, 1232, or 1242 faces the inner surface 1032 of the first holding portion 1031 and that the second holding surface 214, 224, 234, or 244 faces the inner surface 35 of the second holding portion 34. Alternatively, the holder 3 is attachable to the frame body 2 in such an attaching orientation that the first holding surface 1212, 1222, 1232, or 1242 faces the inner surface 35 of the second holding portion 34 and that the second holding surface 214, 224, 234, or 244 faces the inner surface 1032 of the first holding portion 1031. This allows the user to attach the holder 3 to the frame body 2 readily without paying attention to the attaching orientation of the holder 3.

Third Illustrative Embodiment

Figure 17:
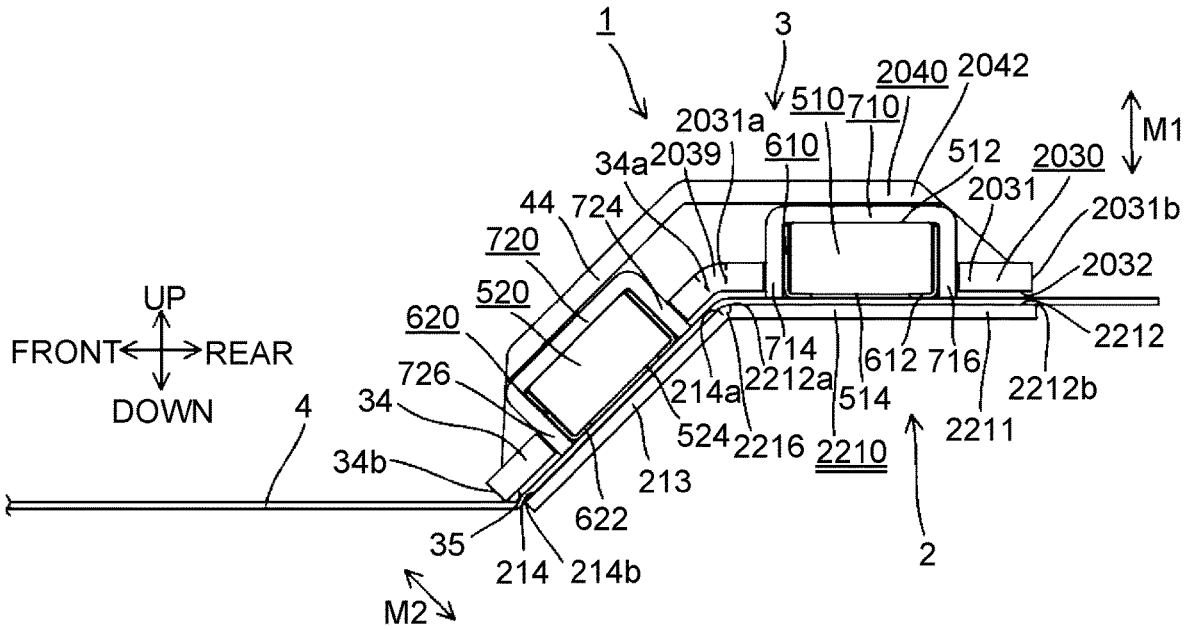
FIG. 17 is a cross-sectional view of a frame side and a holder in a holding frame with a fabric attached, according to a third illustrative embodiment.

Referring to FIG. 17, the structure of a holding frame 1 according to a third illustrative embodiment will be described. The third illustrative embodiment differs from the first illustrative embodiment and the second illustrative embodiment in that a first holding portion 2031 of a holder 3 and a first holding surface 2212 of a frame side 2210, 2220, 2230, or 2240 extend in a width direction which corresponds to a front-rear direction in FIG. 17. Hereinafter, elements different from those in the first illustrative embodiment and those in the second illustrative embodiment will only be described, and the same elements as those in the first illustrative embodiment are indicated by the same reference characters.

Structure of Frame Forming Portion 20

The frame forming portion 20 includes four frame sides including a frame side 2210, and four corners 310, 330, 350 and 370 which have the same structure as those in the first illustrative embodiment.

Structure of Frame Side 2210

The four frame sides including the frame side 2210 have the same structure except that their longitudinal lengths are not uniform, similarly to the frame sides 210, 220, 230, and 240 in the first illustrative embodiment. The structure of the frame side 2210, out of the four frame sides, will be representatively described referring to FIG. 17. The frame side 2210 has a substantially V-shaped cross-section. The frame side 2210 has the same structure as the frame side 210 in the first illustrative embodiment and the frame side 1210 in the second illustrative embodiment except that the frame side 2210 is different in cross-sectional shape from the frame sides 210 and 1210. The frame side 2210 includes side plates 213 and 2211, and a first connecting portion 2216. The side plate 213 is similar in structure to the side plate 213 in the first illustrative embodiment. The side plate 2211 is a flat portion extending in the width direction and in a longitudinal direction which corresponds to a left-right direction. An outer surface of the side plate 2211 is a first holding surface 2212. The first holding surface 2212 includes a first portion 2212*a* and a first end 2212*b*. The first portion 2212*a* is located on one side of the first holding surface 2212 in the width direction. The first end 2212*b* is an end located on the other side of the first holding surface 2212 in the width direction. The first connecting portion 2216 is arcuate. A portion on one side of the first connecting portion 2216 in the width direction is connected to the first portion 2212*a*. A portion on the other side of the first connecting portion 2216 in the width direction is connected to a second portion 214*a*. The frame side 2210 has a substantially V-shaped cross-section, and thus a distance between the first end 2212*b* and the second end 214*b* is greater than a distance between the first portion 2212*a* and the second portion 214*a*.

Assembly of Frame Body 2

A frame body 2 is assembled in a similar manner as in the first illustrative embodiment such that a frame forming portion 20 defines an inner area extending in the front-rear direction and in the left-right direction. The inner area has an area surface extending in the front-rear direction and in the left-right direction. Thus, the first holding surface 2212 extends in a direction parallel to the area surface. The second holding surface 214 extends in a direction inclined by 45 degrees relative to the area surface, i.e., in a direction crossing the area surface.

Structure of Holder 3

Referring to FIG. 17, the structure of the holder 3 will be described in detail. The holder 3 includes an inner wall 2030, an exterior portion 2040, magnets 510 and 520, magnet frames 610 and 620, and yokes 710 and 720. The magnets 510 and 520, the magnet frames 610 and 620, and the yokes 710 and 720 have the same structures as those in the first illustrative embodiment.

Structure of Inner Wall 2030

As shown in FIG. 17, the inner wall 2030 has a substantially V-shaped cross-section. The inner wall 2030 includes a first holding portion 2031, a second holding portion 34, and a second connecting portion 2039. The second holding portion 34 has the same structure as the second holding portion 34 in the first illustrative embodiment. The first holding portion 2031 is a flat portion extending in the width direction and in the longitudinal direction. The first holding portion 2031 has the same structure as the first holding portion 31 in the first illustrative embodiment except that the first holding portion 2031 is parallel to the width direction. The first holding portion 2031 includes a third portion 2031*a* and a third end 2031*b*. The third portion 2031*a* is located on one side of the first holding portion 2031 in the width direction. The third end 2031*b* is an end located on the other side of the first holding portion 2031 in the width direction. The third end 2031*b* is not connected to other portions. The second connecting portion 2039 is arcuate. A portion on one side of the second connecting portion 2039 in the width direction is connected to the third portion 2031*a*. A portion on the other side of the second connecting portion 2039 in the width direction is connected to a fourth portion 34*a*. The inner wall 2030 has a substantially V-shaped cross-section, and thus a distance between an inner surface 2032 at the third end 2031*b* and an inner surface 35 at the fourth end 34*b* is greater than a distance between the inner surface 2032 at the third portion 2031*a* and the inner surface 35 at the fourth portion 34*a*.

Structure of Exterior Portion 2040

The exterior portion 2040 has a substantially V-shaped cross-section. The exterior portion 2040 includes a side plate 44 and an upper plate 2042. The side plate 44 has the same structure as the side plate 44 in the first illustrative embodiment. The upper plate 2042 extends in the width direction and in the longitudinal direction. The upper plate 2042 has the same structure as the side plate 42 in the first illustrative embodiment except that the upper plate 2042 is parallel to the width direction. One side of the side plate 44 in a height direction is connected to one side of the upper plate 2042 in the width direction.

Assembly of Holder 3

The holder 3 is assembled in a similar manner as in the first illustrative embodiment such that surfaces 512 and 514 of the magnet 510 are parallel to the inner surface 2032 of the first holding portion 2031. Thus, the direction of a magnetic field M1 of the magnet 510 is orthogonal to the inner surface 2032. The inner wall 2030 has a substantially V-shaped cross-section, and thus the inner surface 2032 of the first holding portion 2031 is not parallel to the inner surface 35 of the second holding portion 34, and the direction of the magnetic field M1 of the magnet 510 fixed to the first holding portion 2031 is different from the direction of a magnetic field M2 of the magnet 520 fixed to the second holding portion 34.

Attachment of Holder 3 to Frame Body 2

Attachment of the holder 3 to the frame body 2 via a fabric 4, and direct attachment of the holder 3 to the frame body 2 are executed in a similar manner as in the first illustrative embodiment. Since the attaching orientation of the holder 3 to any of the four frame sides including the frame side 2210 is the same, the attaching orientation of the holder 3 to the frame side 2210 will be representatively described. As shown in FIG. 17, the inner surface 2032 of the first holding portion 2031, the surface 514 of the magnet 510, the base 612 of the magnet frame 610, and ends of the side plates 714 and 716 of the yoke 710 face the first holding surface 2212 of the frame side 2210. The inner surface 35 of the second holding portion 34, the surface 524 of the magnet 520, the base 622 of the magnet frame 620, and ends of the side plates 724 and 726 of the yoke 720 face the second holding surface 214 of the frame side 2210. Since the frame side 2210 is made of a magnetic material, a magnetic force is generated between the magnet 510 and the first holding surface 2212 to attract each other, and between the magnet 520 and the second holding surface 214 to attract each other. The frame forming portion 20 and the holder 3 securely hold the fabric 4 due to magnetic forces between each of the magnets 510 and 520 and any of the four frame sides including the frame side 2210.

In a state where the holder 3 is attached to the frame body 2, the first holding surface 2212 faces the first holding portion 2031, and the second holding surface 214 faces the second holding portion 34. As shown in FIG. 17, the first holding portion 2031 extend in the front-rear direction parallel to the area surface. The second holding surface 34 extends in a direction inclined by 45 degrees relative to the area surface, i.e., in a direction crossing the area surface.

Effects of Holding Frame 1

The four frame sides, including the frame side 2210, of the frame body 2 each have a substantially V-shaped cross-section, as shown in FIG. 17. The distance between the first end 2212*b* and the second end 214*b* is greater than the distance between the first portion 2212*a* and the second portion 214*a*. The holders 3 are attached to the four frame sides including the frame side 2210 and each having the cross-section shown in FIG. 17. Even when the thickness varies considerably from one fabric 4 to another, the holders 3 are shiftable upward by the thickness of a fabric 4, relative to the four frame sides including the frame side 2210. Accordingly, a gap is provided between the frame body 2 and each holder 3, depending on the thickness of the fabric 4, and thus the holders 3 and the frame body 2 hold the fabric 4 therebetween.

As shown in FIG. 17, the inner wall 2030 of the holder 3 has a substantially V-shaped cross-section, and the distance between the inner surface 2032 at the third end 2031*b* and the inner surface 35 at the fourth end 34*b* is greater than the distance between the inner surface 2032 at the third portion 2031*a* and the inner surface 35 at the fourth end 34*a*. The holders 3 each having the cross-section shown in FIG. 17 are attached to the four frame sides including the frame side 2210. Even when the thickness varies considerably from one fabric to another, the holders 3 are shiftable upward by the thickness of a fabric 4, relative to the four frame sides including the frame side 2210. Accordingly, a gap is provided between the frame body 2 and each holder 3, depending on the thickness of the fabric 4, and thus the holders 3 and the frame body 2 hold the fabric 4 therebetween.

In a state where the holder 3 is attached to the frame body 2, as shown in FIG. 17, the first holding portion 2031 of the holder 3 is a flat portion extending in the front-rear direction parallel to the area surface. The third end 2031*b* is not connected to other portions. The holders 3 each having such a structure are attached to the four frame sides including the frame side 2210. Even when the thickness varies considerably from one fabric 4 to another, the holders 3 are movable in a direction parallel to the area surface by the thickness of a fabric 4, relative to the four frame sides including the frame side 2210. In short, while the holder 3 is movable frontward in FIG. 17 relative to the frame side 2210, the holder 3 and the frame side 2210 hold the fabric 4 therebetween.

Modifications

The disclosure may not be limited to the above-described embodiments, and various changes may be applied therein without departing from the spirit and scope of the disclosure.

Figure 18:
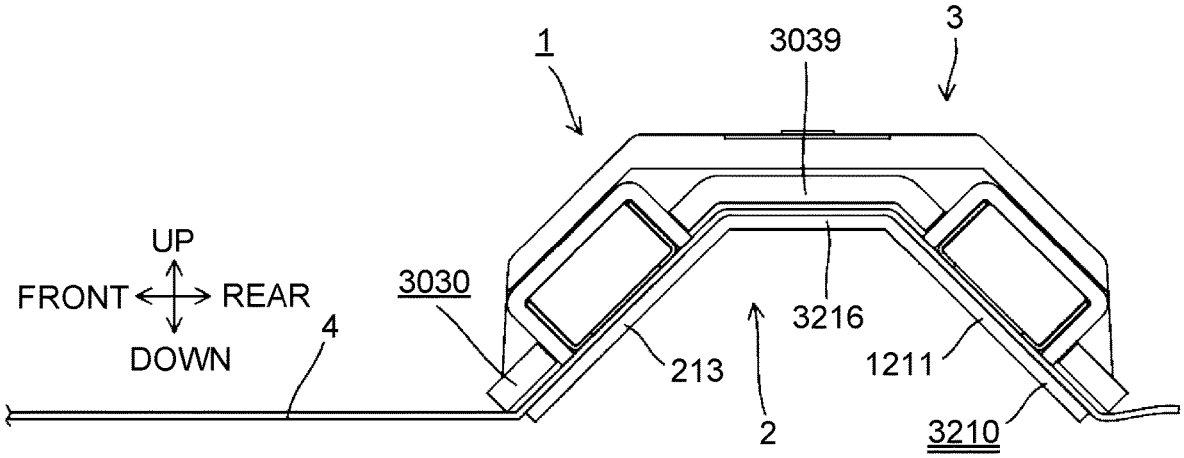
FIG. 18 is a cross-sectional view of a substantial part of a holding frame with a fabric attached, according to a modification.

(1) In the above-described embodiments, as shown in FIGS. 3, 16, and 17, the corresponding first connecting portion 216, 1216, or 2216 of the frame side 210, 1210, or 2210 is arcuate. However, as shown in FIG. 18, a first connecting portion 3216 may be a flat portion extending in a width direction which corresponds to a front-rear direction in FIG. 18 and in a longitudinal direction which corresponds to a left-right direction in FIG. 18. As shown in FIGS. 11, 16 and 17, the corresponding second connecting portion 39, 1039, or 2039 of the inner wall 30, 1030, or 2030 of the holder 3 is arcuate. However, as shown in FIG. 18, a second connecting portion 3039 of an inner wall 3030 may be a flat portion extending in the width direction which corresponds to the front-rear direction in FIG. 18 and in the longitudinal direction which corresponds to the left-right direction in FIG. 18. Such structures also enable a holder 3 and a frame forming portion 20 to securely hold a fabric 4 therebetween even when the thickness varies considerably from one fabric 4 to another.

Figure 19:
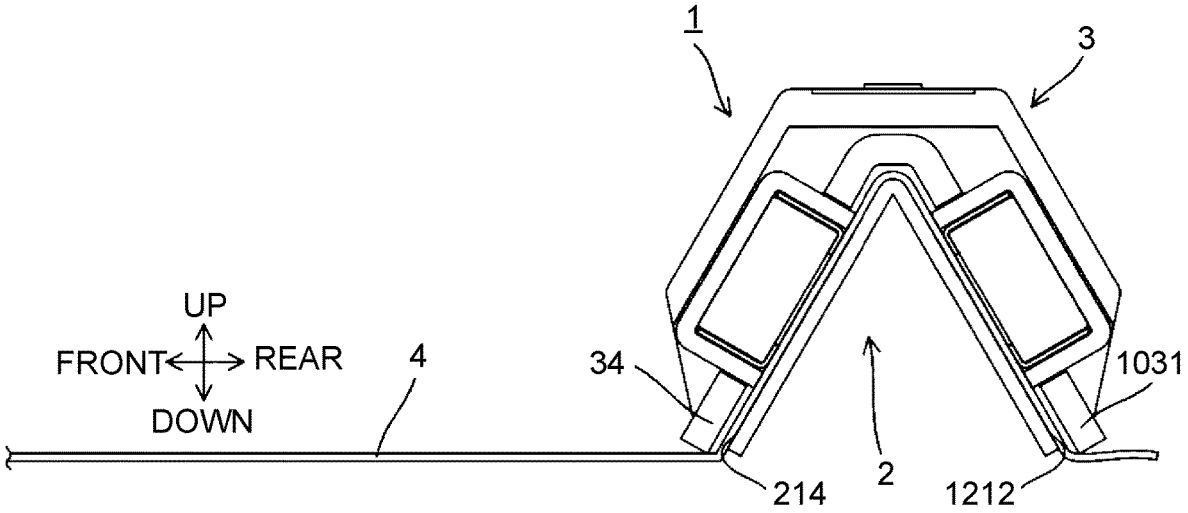
FIG. 19 is a cross-sectional view of a substantial part of a holding frame with a fabric attached, according to a modification.

(2) In the above-described second embodiment, as shown in FIG. 16, the first holding surface 1212 and the second holding surface 214 are inclined by 45 degrees relative to the width direction so as to be orthogonal to each other. However, as shown in FIG. 19, a first holding surface 1212 and a second holding surface 214 may form an acute angle therebetween. Also, as shown in FIG. 19, a first holding portion 1031 and a second holding portion 34 may form an acute angle therebetween. Such structures enable a holding frame 1 to hold a fabric 4 in a bent manner, thereby reducing sliding of the fabric 4 between the frame body 2 and a holder 3 when the fabric 4 held therebetween is pulled in an inner area A1.

(3) In the above-described second embodiment, as shown in FIG. 16, the first holding surface 1212 and the second holding surface 214 are inclined by 45 degrees relative to the width direction so as to be orthogonal to each other. However, in the above-described third embodiment, as shown in FIG. 17, the first holding surface 2212 and the second holding surface 214 may form an obtuse angle therebetween. Also, as shown in FIG. 17, the first holding portion 2031 and the second holding portion 34 may form an obtuse angle therebetween. Such structures may reduce the likelihood of a trace to be left on a fabric 4 when the fabric 4 is held between the frame body 2 and the holder 3 and pressed due to a magnetic force acting therebetween. The holding frame 1 holds the fabric 4 in a bent manner, thereby reducing sliding of the fabric 4 between the frame body 2 and the holder 3 when the fabric 4 held therebetween is pulled in an inner area A1.

Figure 20:
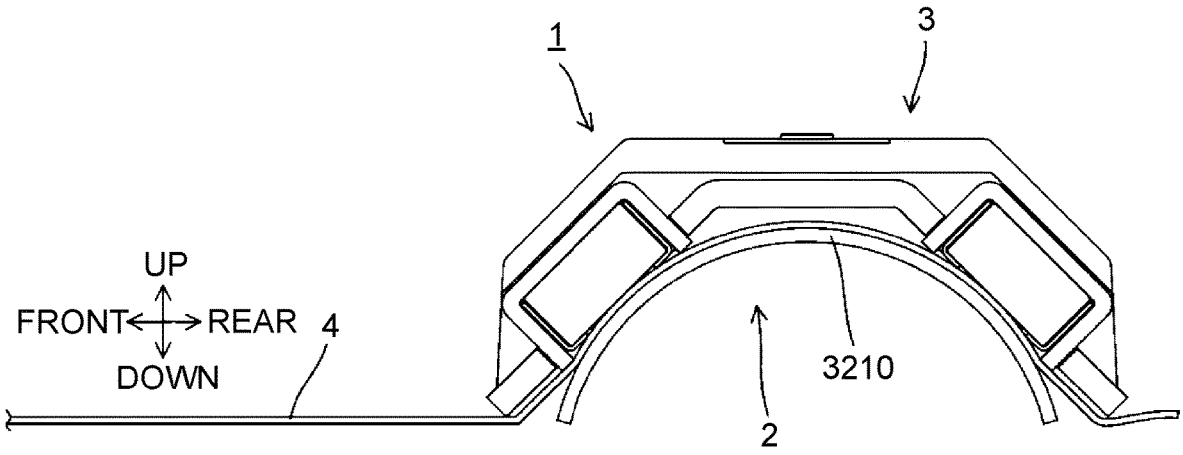
FIG. 20 is a cross-sectional view of a substantial part of a holding frame with a fabric attached, according to a modification.

(4) In the above-described embodiments as shown in FIGS. 13, 16, and 17, the frame side 210, 1210, or 2210 has a substantially right triangle shape or a substantially V shape in cross-section. However, as shown in FIG. 20, a frame side 3210 may have a curved shape, such as an arcuate shape. Such a structure may reduce the likelihood of a trace to be left on a fabric 4 when the fabric 4 is held between the frame body 2 and the holder 3 and pressed due to a magnetic force acting therebetween. This structure enables a holding frame 1 to hold the fabric 4 in a bent manner, thereby reducing sliding of the fabric 4 between the frame body 2 and the holder 3 when the fabric 4 held therebetween is pulled in an inner area A1.

Figure 21:
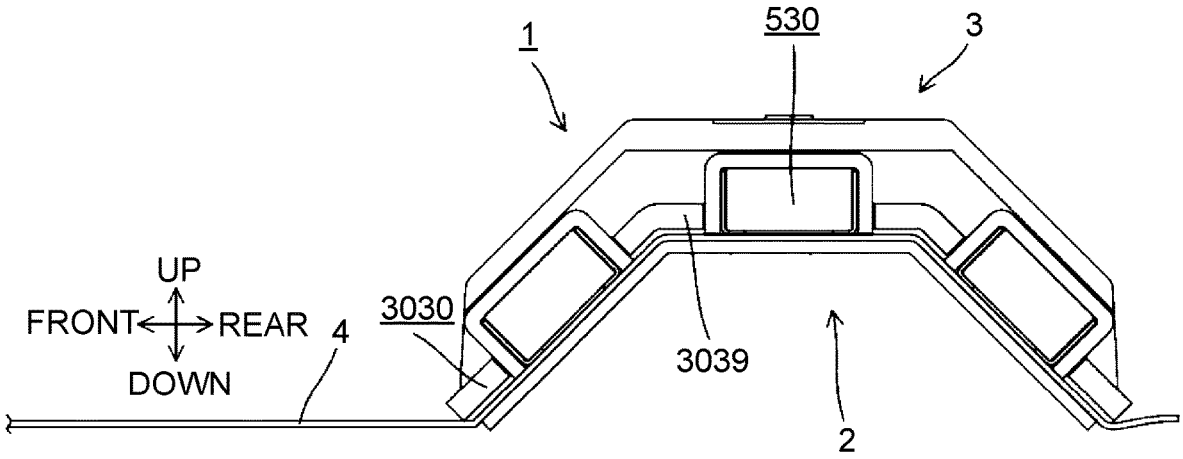
FIG. 21 is a cross-sectional view of a substantial part of a holding frame with a fabric attached, according to a modification.

(5) In the above-described embodiments, as shown in FIGS. 13, 16, and 17, the two magnets 510 and 520 are disposed at the inner wall 30, 1030, or 2030 such that the magnets 510 and 520 generate the magnetic fields M1 and M2 in different directions. However, as shown in FIG. 21, another magnet 530 may be disposed at a second connecting portion 3039 of an inner wall 3030. Magnets 510, 520, and 530 disposed at the inner wall 3030 may generate magnetic fields in different directions. Such a structure enables a holder 3 and a frame forming portion 20 to securely hold a fabric 4 therebetween even when the thickness varies considerably from one fabric 4 to another.

Figure 22:
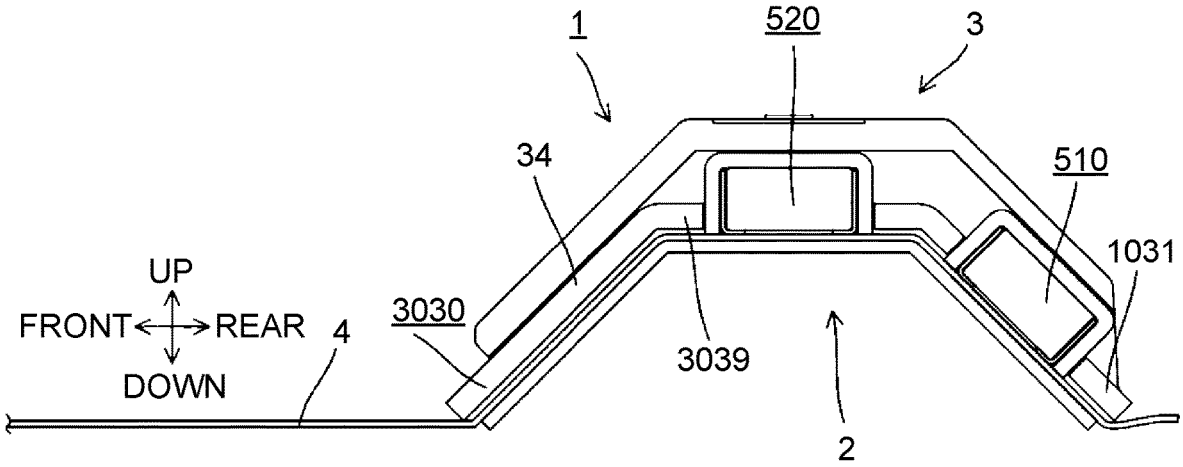
FIG. 22 is a cross-sectional view of a substantial part of a holding frame with a fabric attached, according to a modification.

(6) In the above-described embodiments, as shown in FIGS. 13, 16, and 17, the magnet 510 is disposed at the first holding portion 31, 1031, or 2031, and the magnet 520 is disposed at the second holding portion 34. However, as shown in FIG. 22, magnets 510 and 520 may be attached to a first holding portion 1031 and a second connecting portion 3039, respectively. Alternatively, magnets 510 and 520 may be attached to the second connecting portion 3039 and a second holding portion 34, respectively. Such structures also enable a holder 3 and a frame forming portion 20 to securely hold a fabric 4 therebetween even when the thickness varies considerably from one fabric 4 to another.

Figure 23:
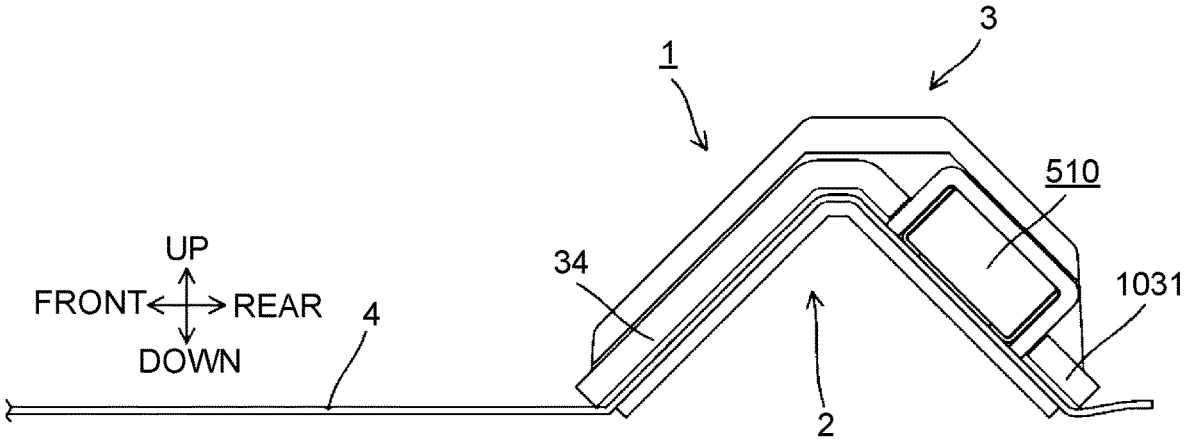
FIG. 23 is a cross-sectional view of a substantial part of a holding frame with a fabric attached, according to a modification.
Figure 24:
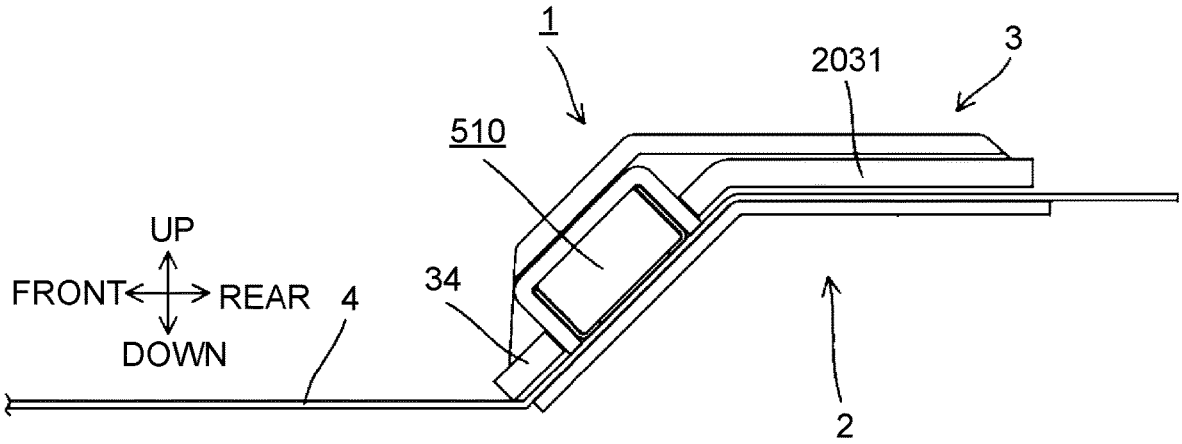
FIG. 24 is a cross-sectional view of a substantial part of a holding frame with a fabric attached, according to a modification.

(7) In the above-described embodiments, as shown in FIGS. 13, 16, and 17, the magnet 510 is attached to the first holding portion 31, 1031, or 2031, and the magnet 520 is attached to the second holding portion 34. However, as shown in FIGS. 23 and 24, a single magnet 510 may be attached to one of a first holding portion 31, 1031, or 2031, and a second holding portion 34. Alternatively, a single magnet 510 may be attached to only at the second correcting portion 3039 shown in FIG. 22. Such structures also enable a holder 3 and a frame forming portion 20 to securely hold a fabric 4 therebetween even when the thickness varies considerably from one fabric 4 to another.

(8) In the above-described embodiments, as shown in FIGS. 13, 16, and 17, the frame side 210, 1210, or 2210 is made of a magnetic material, and the magnet 510 is attached to the first holding portion 31, 1031, or 2031, and the magnet 520 is attached to the second holding portion 34. However, a plurality of magnets may be attached to the frame side 210, 1210, or 2210, and the inner wall 30, 1030, or 2030 may be made of a magnetic material. Such structures also enable a holder 3 and a frame forming portion 20 to securely hold a fabric 4 therebetween even when the thickness varies considerably from one fabric 4 to another.

(9) In the above-described embodiments, as shown in FIGS. 2, 15, and 17, the first holding surfaces 212, 222, 232, 242; 1212, 1222, 1232, 1242; and 2212, and the second holding surfaces 214, 224, 234, and 244 are made of only a magnetic material, but may include a magnetic material and a non-magnetic material. Such structures also enable a holder 3 and a frame forming portion 20 to securely hold a fabric 4 therebetween even when the thickness varies considerably from one fabric 4 to another.

Figure 25:
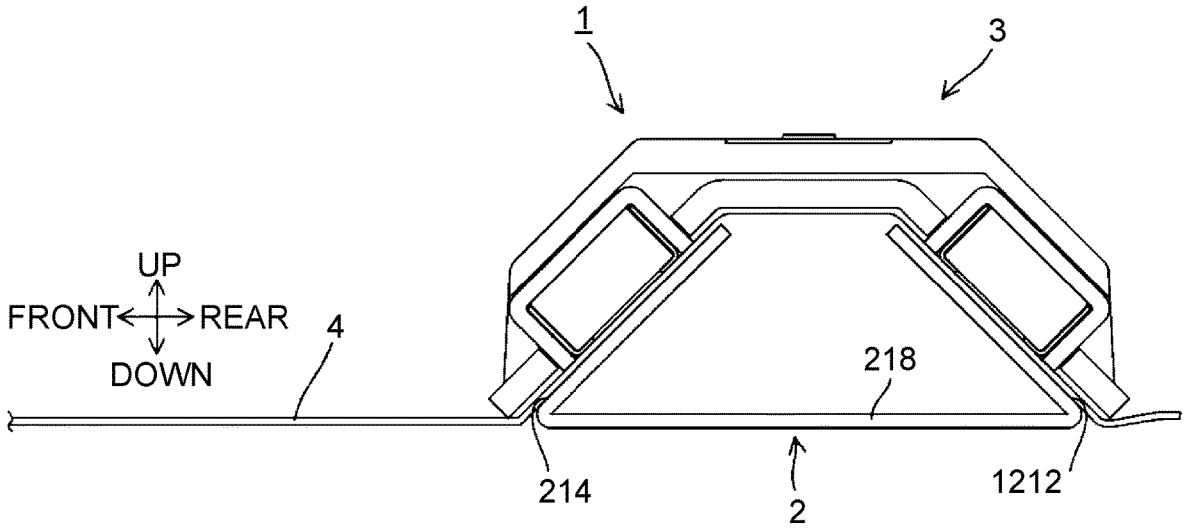
FIG. 25 is a cross-sectional view of a substantial part of a holding frame with a fabric attached, according to a modification.

(10) In the above-described embodiments, as shown in FIGS. 3, 16, and 17, the corresponding first connecting portion 216, 1216, or 2216 of the frame side 210, 1210, or 2210 connects the first holding surface 212, 1212, or 2212 and the second holding surface 214. However, as shown in FIG. 25, a bottom plate 218 may connect a lower portion of a first holding surface 1212 and a lower portion of a second holding surface 214, without the first connecting portion

216, 1216, or 2216. Such a structure also enables a holder 3 and a frame forming portion 20 to securely hold a fabric 4 therebetween even when the thickness varies considerably from one fabric 4 to another.

Figure 26:
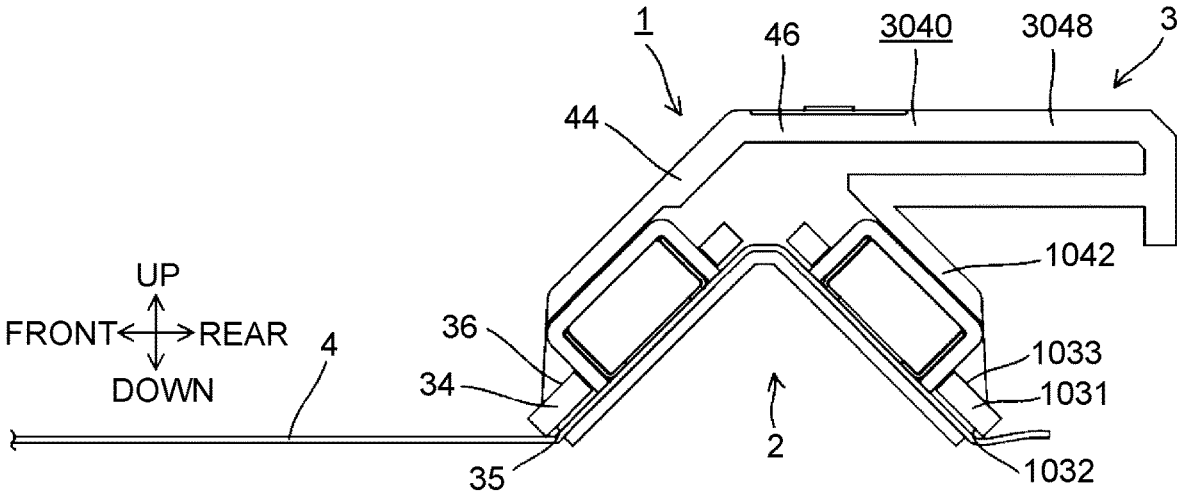
FIG. 26 is a cross-sectional view of a substantial part of a holding frame with a fabric attached, according to a modification.

(11) In the above-described embodiments, as shown in FIGS. 11, 16, and 17, the corresponding second connecting portion 39, 1039, or 2039 of the inner wall 30, 1030, or 2030 connects the first holding portion 31, 1031, or 2031 and the second holding portion 34. However, as shown in FIG. 26, an external portion 3040 may connect a first holding portion 1031 and a second holding portion 34, without the second connecting portion 39, 1039, or 2039. Namely, the external portion 3040 may be screwed to the first holding portion 1031, and the external portion 3040 may be screwed to the second holding portion 34. In this case, the external portion 3040 corresponds to a second connecting portion according to an aspect of the disclosure. Such structures also enable a holder 3 and a frame forming portion 20 to securely hold a fabric 4 therebetween even when the thickness varies considerably from one fabric 4 to another.

(12) In the above-described embodiments, as shown in FIGS. 3, 16, and 17, the first connecting portion 216, 1216, or 2216 connects the corresponding first holding surface 212, 1212, or 2212 and the second holding surface 214. However, the corners 310 and 330 may connect the first holding surface 212, 1212, or 2212, and the second holding surface 214, without the first connecting portion 216, 1216, or 2216. Namely, the corners 310 and 330 may be screwed to the first holding surface 212, 1212, or 2212, and the corners 310 and 330 may be screwed to the second holding surface 214. In this case, the corners 310 and 330 corresponds to a first connecting portion according to an aspect of the disclosure. Such structures also enable a holder 3 and a frame forming portion 20 to securely hold a fabric 4 therebetween even when the thickness varies considerably from one fabric 4 to another.

Figure 27:
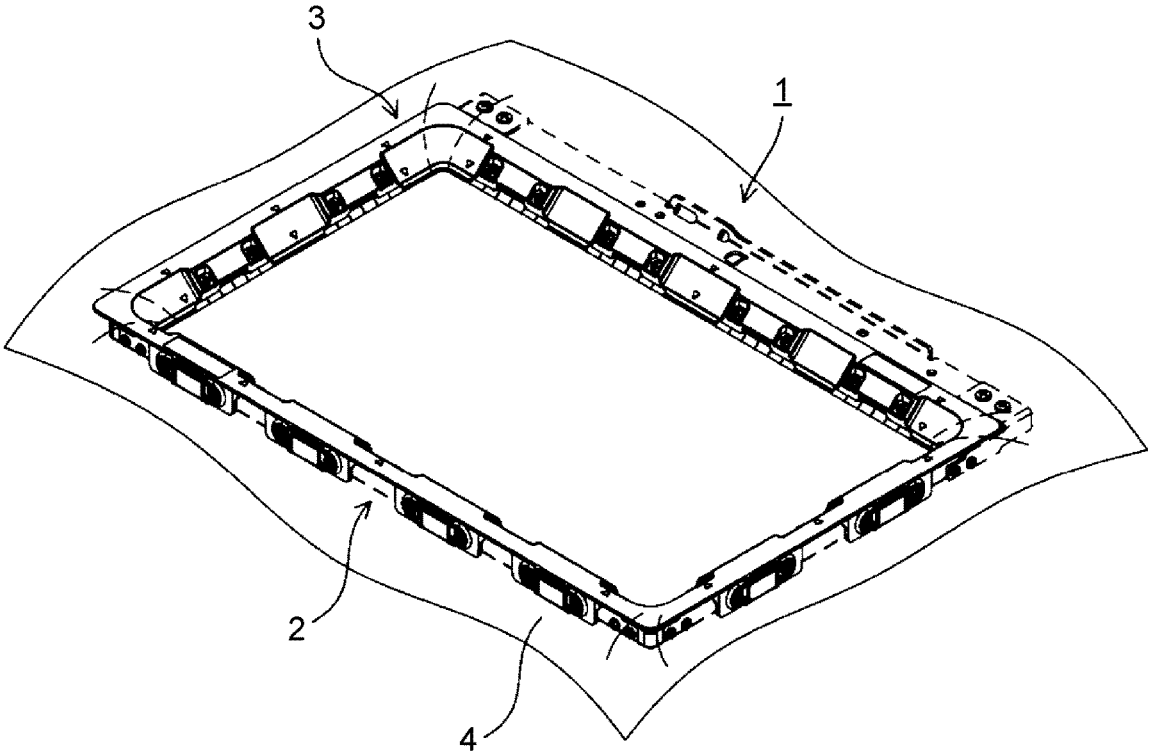
FIG. 27 is a perspective view of a holding frame with a fabric attached, according to a modification.

(13) In the above-described embodiments, as shown in FIGS. 12 and 15, a plurality of holders 3 are attached, from above the fabric 4, to the frame forming portion 20. However, as shown in FIG. 27, a ring-shaped holder 3 may be attached to a frame forming portion 20. In such a structure, as long as the holder 3 has any one of the cross-sectional shapes shown in FIGS. 8 and 16 to 26, the holder 3 may, as shown in FIG. 27, be ring-shaped and have the same shape as the frame forming portion 20. In such a structure, only an external portion may be formed into a ring shape, or both an inner wall and an external portion may be formed into a ring shape.

(14) In the above-described first embodiment, as shown in FIG. 7, the grips 48 are disposed at the second holding portion 34 to extend from the side surfaces 37 and 38 of the inner wall 30. However, as shown in FIG. 26, a holder 3 may include a grip 3048 protruding from a side plate 1042 rearward in FIG. 26 in a direction from an inner surface 1032 toward an outer surface 1033 of a first holding portion 1031. Alternatively, the holder 3 may include a grip protruding from a side plate 44 frontward in FIG. 26 in a direction from an inner surface 35 toward an outer surface 36 of a second holding portion 34. The grip 3048 included in the holder 3 facilitates a user to remove, by holding the grip 3048, the holder 3 from a frame body 3.

(15) In the above-described embodiments, as shown in FIGS. 2 and 15, the frame forming portion 20 has a substantially rectangular shape, but may have a polygonal shape other than the rectangular. The polygonal shape includes a triangle, a pentagon, a hexagon, and an octagon. The frame forming portion 20 may be formed into a desired polygonal shape by adjusting the angles formed by the two arm portions 311 and 315 of each of the corners 310, 330, 350, and 370 as appropriate.

(16) In the above-described embodiments, as shown in FIGS. 2 and 15, the frame forming portion 20 has a substantially rectangular shape in plan view, but may have a curved shape, such as a circle or an ellipse. The frame forming portion 20 may be formed into a desired curved shape by adjusting the angles formed by the two arm portions 311 and 315 of each of the corners 310, 330, 350, and 370 as appropriate. The frame sides 210, 220, 230, 240, 1210, 1220, 1230, 1240, 2210, and 3210 are shaped to extend linearly in the longitudinal direction, but may be shaped to curve arcuately. The holder 3 is shaped to extend linearly in the longitudinal direction, but may be shaped to curve arcuately.

(17) In the above-described embodiments, as shown in FIGS. 13, 16, and 17, the magnets 510 and 520 are permanent magnets, but may be electromagnets.

(18) In the above-described embodiments, as shown FIGS. 1, 2, 15, and 27, the frame body 2 includes the frame forming portion 20 and the attachment 10. However, the frame body 2 may include the frame forming portion 20 but may not include the attachment 10.

(19) In the above-described embodiments, as shown in FIGS. 12 to 27, the holding frame 1 holds a fabric 4, but may hold other workpieces such as a leather sheet, a resin sheet, and a paper sheet. In the above-described embodiments, the holding frame 1 which holds a workpiece is mounted to the sewing machine which in turn sews in the workpiece. However, the holding frame 1 which holds a workpiece may be mounted to a printer which in turn prints on the workpiece.

The holding frame 1 is an example of a holding frame according to an aspect of the disclosure. The inner areas A1 and A2 are each an example of an inner area according to an aspect of the disclosure. The area surfaces P1 and P2 are each an example of an area surface according to an aspect of the disclosure. The frame forming portion 20 is an example of a frame forming portion according to an aspect of the disclosure. The frame side 210 is an example of an attachment according to an aspect of the disclosure. The frame sides 210, 220, 230, 240, 1210, 1220, 1230, 1240, 2210, and 3210 are each an example of a frame side according to an aspect of the disclosure. The first holding surfaces 212, 222, 232, 242, 1212, 1222, 1232, 1242, and 2212 are each an example of a first holding surface according to an aspect of the disclosure. The second holding surfaces 214, 224, 234, and 244 are each an example of a second holding surface according to an aspect of the disclosure. The first connecting portions 216, 1216, 2216, and 3216 are each an example of a first connecting portion according to an aspect of the disclosure. The first portions 212*a*, 1212*a*, and 2212*a* are each an example of a first portion according to an aspect of the disclosure. The first ends 212*b*, 1212*b*, and 2212*b* are each an example of a first end according to an aspect of the disclosure. The second portion 214*a* is an example of a second portion according to an aspect of the disclosure. The second end 214*b* is an example of a second end according to an aspect of the disclosure. The distance D1 is an example of a distance between the first end and the second end according to an aspect of the disclosure. The distance D2 is an example of a distance between the first portion and the second portion according to an aspect of the disclosure. The holder 3 is an example of a holder according to an aspect of the disclosure. The first holding portions 31, 1031, and 2031 are each an example of a first holding portion according to an aspect of the disclosure. The second holding portion 34 is an example of a second holding portion according to an aspect of the disclosure. The second connecting portions 39, 1039, 2039, and 3039 are each an example of a second connecting portion according to an aspect of the disclosure. The inner surfaces 32, 1032, and 2032 are each an example of an inner surface of the first holding portion according to an aspect of the disclosure. The outer surface 1033 is an example of an outer surface of the first holding portion according to an aspect of the disclosure. The inner surface 35 is an example of an inner surface of the second holding portion according to an aspect of the disclosure. The outer surface 36 is an example of an outer surface of the second holding portion according to an aspect of the disclosure. The third portions 31*a*, 1031*a*, and 2031*a* are each an example of a third portion according to an aspect of the disclosure. The third ends 31*b*, 1031*b*, and 2031*b* are each an example of a third end according to an aspect of the disclosure. The fourth portion 34*a* is an example of a fourth portion according to an aspect of the disclosure. The fourth end 34*b* is an example of a fourth end according to an aspect of the disclosure. The distance D3 is an example of a distance between the inner surface at the third end and the inner surface at the fourth end according to an aspect of the disclosure. The distance D4 is an example of a distance between the inner surface at the third portion and the inner surface at the fourth portion according to an aspect of the disclosure. The side surfaces 37 and 38 are each an example of a side surface of the second holding portion according to an aspect of the disclosure. The longitudinal direction of the holder 3 is an example of a first direction according to an aspect of the disclosure. The grip 48 is an example of a first grip according to an aspect of the disclosure. The grip 3048 is an example of a second grip according to an aspect of the disclosure. The magnet 510 is an example of a first permanent magnet according to an aspect of the disclosure. The magnet 520 is an example of a second permanent magnet according to an aspect of the disclosure. The fabrics 4, 4*a*, and 4*b* are each an example of a workpiece according to an aspect of the disclosure. The sewing machine in the first illustrative embodiment is an example of a processing machine according to an aspect of the disclosure. The attachment 10 is an example of an attachment according to an aspect of the disclosure.

What is claimed is:

1. A holding frame comprising:

a frame forming portion defining an inner area which extends in a direction in which a workpiece is stretched taut, the frame forming portion including:

a first holding surface defined by a first portion of the frame forming portion;

a second holding surface defined by a second portion of the frame forming portion; and a first connecting portion connecting the first holding surface and the second holding surface; and a holder configured to be magnetically attached to the frame forming portion, the holder including:

a first holding portion; and a second holding portion, wherein the first holding surface and the second holding surface extend in two different directions crossing the direction in which the workpiece is stretched taut, wherein the first holding surface includes a first portion connected to the first connecting portion, and a first end located opposite from the first portion, the second holding surface includes a second portion connected to the first connecting portion, and a second end located opposite from the second portion, and a distance between the first end and the second end is greater than a distance between the first portion and the second portion, wherein, in a state where the holder is attached to the frame forming portion, the first holding surface faces an inner surface of the first holding portion, and the second holding surface faces an inner surface of the second holding portion, wherein one of the first holding portion and the first holding surface includes a magnet and the other includes a magnetic material, and wherein one of the second holding portion and the second holding surface includes a magnet and the other includes a magnetic material.

2. The holding frame according to claim 1, wherein the holder includes a second connecting portion connecting the first holding portion and the second holding portion, the first holding portion includes a third portion connected to the second connecting portion, and the second holding portion includes a fourth portion connected to the second connecting portion, wherein a distance between the inner surface at the third portion and the inner surface at the fourth portion is greater than the distance between the first portion and the second portion, and wherein, in the state where the holder is attached to the frame forming portion, an inner surface of the second connecting portion faces the first connecting portion of the frame forming portion.

3. The holding frame according to claim 2, wherein the second holding portion includes the fourth portion connected to the second connecting portion, and a fourth end located opposite from the fourth portion, and the second holding portion includes a side surface extending in a direction crossing a first direction which is perpendicular to a direction from the fourth portion toward the fourth end and is parallel to the inner surface of the second holding portion, and wherein the holder includes a first grip disposed on the second holding portion to protrude from the side surface.

4. The holding frame according to claim 1, wherein the holder includes a second grip disposed on an outer surface opposite to the inner surface of the first holding portion or the second holding portion, the second grip protruding in a direction from the inner surface toward the outer surface.

5. The holding frame according to claim 1, wherein an angle formed by the direction in which the workpiece is stretched taut and the first holding surface is equal to an angle formed by the direction in which the workpiece is stretched taut and the second holding surface.

6. The holding frame according to claim 1, wherein the first holding surface is located outside the second holding surface in an outward direction away from the inner area of the frame forming portion, wherein the frame forming portion includes an attachment configured to receive a mount to be mounted on a processing machine for processing the workpiece, and the attachment extends linearly in a longitudinal direction of the frame forming portion and has the first holding surface which is a plane perpendicular to the direction in which the workpiece is stretched taut.

7. The holding frame according to claim 6, wherein the frame forming portion is polygonal and includes a plurality of frame sides including the attachment as a frame side, and the first holding surface of each of the frame sides is a plane perpendicular to the direction in which the workpiece is stretched taut.

8. The holding frame according to claim 1, wherein the frame forming portion is polygonal and includes a plurality of frame sides which are equal in number to polygonal sides, and wherein the holding frame comprises a plurality of holders, the plurality of holders includes the holder, and a number of the plurality of holders is greater than or equal to a number of the polygonal sides.

9. The holding frame according to claim 1, wherein the holder is ring-shaped and has a same shape as the frame forming portion.

10. A holding frame comprising:

a frame forming portion including four frame sides defining an inner area which extends in a direction in which a workpiece is stretched taut, each of the four frame sides including:

a first holding surface;

a second holding surface;

a first connecting portion connecting the first holding surface and the second holding surface; and a portion including a magnetic material; and a holder including:

a first holding portion; and a second holding portion, wherein the first holding surface and the second holding surface extend in two different directions crossing the direction in which the workpiece is stretched taut, wherein the first holding surface is a plane perpendicular to the direction in which the workpiece is stretched taut and located outside the second holding surface in an outward direction away from the inner area of the frame forming portion, wherein the first holding surface includes a first portion connected to the first connecting portion, and a first end located opposite from the first portion, the second holding surface includes a second portion connected to the first connecting portion, and a second end located opposite from the second portion, and a distance between the first end and the second end is greater than a distance between the first portion and the second portion, wherein, in a state where the holder is attached to a corresponding one of the frame sides, the first holding surface of the corresponding frame side faces an inner surface of the first holding portion, and the second holding surface of the corresponding frame side faces an inner surface of the second holding portion, and wherein the first holding portion includes, on the inner surface thereof, a first permanent magnet, and the second holding portion includes, on the inner surface thereof, a second permanent magnet.

11. A holding frame comprising:

a frame forming portion defining an inner area which extends in a direction in which a workpiece is stretched taut, the frame forming portion including:

a first holding surface defined by a first portion of the frame forming portion; and a second holding surface defined by a second portion of the frame forming portion; and a holder configured to be magnetically attached to the frame forming portion, the holder including:

a first holding portion;

a second holding portion; and a second connecting portion connecting the first holding portion and the second holding portion, wherein, in a state where the holder is attached to the frame forming portion, the first holding portion and the second holding portion extend in two different directions crossing the direction in which the workpiece is stretched taut, wherein the first holding portion includes a third portion connected to the second connecting portion, and a third end located opposite from the third portion, the second holding portion includes a fourth portion connected to the second connecting portion, and a fourth end located opposite from the fourth portion, and a distance between an inner surface at the third end of the first holding portion and an inner surface at the fourth end of the second holding portion is greater than a distance between the inner surface at the third portion of the first holding portion and the inner surface at the fourth portion of the second holding portion, wherein, in the state where the holder is attached to the frame forming portion, the first holding surface faces the inner surface of the first holding portion, and the second holding surface faces the inner surface of the second holding portion, wherein one of the first holding portion and the first holding surface includes a magnet and the other includes a magnetic material, and wherein one of the second holding portion and the second holding surface includes a magnet and the other includes a magnetic material.

12. A holding frame comprising:

a frame forming portion defining an inner area which extends in a direction in which a workpiece is stretched taut, the frame forming portion including:

a first holding surface defined by a first portion of the frame forming portion; and a second holding surface defined by a second portion of the frame forming portion; and a holder configured to be magnetically attached to the frame forming portion, the holder including:

a first holding portion;

a second holding portion; and a second connecting portion connecting the first holding portion and the second holding portion, wherein, in a state where the holder is attached to the frame forming portion, the first holding portion extends in a direction parallel to an area surface of the inner area, and the second holding portion extends in a direction crossing the direction in which the workpiece is stretched taut, wherein the first holding portion includes a third portion connected to the second connecting portion, and a third end located opposite from the third portion, the second holding portion includes a fourth portion connected to the second connecting portion, and a fourth end located opposite from the fourth portion, and a distance between an inner surface at the third end of the first holding portion and an inner surface at the fourth end of the second holding portion is greater than a distance between the inner surface at the third portion of the first holding portion and the inner surface at the fourth portion of the second holding portion, wherein, in the state where the holder is attached to the frame forming portion, the third end is configured such that the holder is movable in the direction parallel to the direction in which the workpiece is stretched taut, wherein, in the state where the holder is attached to the frame forming portion, the first holding surface faces the inner surface of the first holding portion, and the second holding surface faces the inner surface of the second holding portion, wherein one of the first holding portion and the first holding surface includes a magnet and the other includes a magnetic material, and wherein one of the second holding portion and the second holding surface includes a magnet and the other includes a magnetic material.

13. A holder configured to be magnetically attached to a holding frame which includes a frame forming portion defining an inner area extending in a direction in which a workpiece is stretched taut, the holder comprising:

a first holding portion;

a second holding portion, and a second connecting portion connecting the first holding portion and the second holding portion, wherein, in a state where a holder is attached to the frame forming portion, the first holding portion and the second holding portion extend in two different directions crossing the direction in which the workpiece is stretched taut, wherein the first holding portion includes a third portion connected to the second connecting portion, and a third end located opposite from the third portion, the second holding portion includes a fourth portion connected to the second connecting portion, and a fourth end located opposite from the fourth portion, and a distance between an inner surface at the third end of the first holding portion and an inner surface at the fourth end of the second holding portion is greater than a distance between the inner surface at the third portion of the first holding portion and the inner surface at the fourth portion of the second holding portion, and wherein at least two of the first holding portion, the second holding portion, and the second connecting portion include a magnet.

* * * * *